US006486754B1

(12) United States Patent
Hidaka et al.

(10) Patent No.: US 6,486,754 B1
(45) Date of Patent: Nov. 26, 2002

(54) RESONATOR, FILTER, DUPLEXER, AND COMMUNICATION DEVICE

(75) Inventors: Seiji Hidaka; Michiaki Ota, both of Nagaokakyo; Shin Abe, Muko; Yohei Ishikawa, Kyoto, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/470,182

(22) Filed: Dec. 22, 1999

(30) Foreign Application Priority Data

Dec. 22, 1998 (JP) ..... 10-363949
Apr. 7, 1999 (JP) ..... 11-099850

(51) Int. Cl.[7] ..... H01P 7/00; H01P 1/18; H01P 1/20; H01P 5/12; H01P 3/08

(52) U.S. Cl. ..... 333/219; 333/161; 333/204; 333/134; 333/238

(58) Field of Search ..... 333/219, 161, 333/202, 134, 204, 156, 236, 238, 245, 246

(56) References Cited

U.S. PATENT DOCUMENTS

| | | | | |
|---|---|---|---|---|
| 3,769,616 A | | 10/1973 | Singh | 333/73 S |
| 4,499,441 A | * | 2/1985 | Lynch et al. | 333/161 |
| 4,757,285 A | | 7/1988 | Krause | 333/203 |
| 4,981,838 A | | 1/1991 | Whitehead | 505/1 |
| 5,276,398 A | * | 1/1994 | Withers et al. | 324/318 |
| 6,029,075 A | * | 2/2000 | Das | 333/161 |
| 6,108,569 A | * | 8/2000 | Shen | 333/219 |

FOREIGN PATENT DOCUMENTS

| | | |
|---|---|---|
| EP | 0255068 | 2/1988 |
| JP | 832320 | 2/1996 |

OTHER PUBLICATIONS

U.R. Kraft, "Polarisation Properties of Small Printed Spiral Antennas With Four Resistively Loaded Arms," IEE Proceedings: Microwaves, Antennas and Propagation, GB, IEE, Stevenage, Herts, vol. 144, No. 2, pp. 131–135 (Apr. 1, 1997) (XP000677383).

European Search Report issued Mar. 22, 2001 in a related application.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A resonator can provide good loss characteristics by effectively suppressing power losses due to an edge effect. In addition, a filter, a duplexer, and a communication device incorporating the resonator are formed. In the resonator, a plurality of spiral lines are disposed on a surface of a dielectric substrate in such a manner that the inner and outer ends of the lines are aligned respectively along an inner periphery and an outer periphery which are centered around a central point on the substrate so that the lines do not cross each other. With this arrangement, the edge effect in the spiral lines is substantially canceled, by which power losses due to the edge effect can be effectively suppressed.

18 Claims, 29 Drawing Sheets

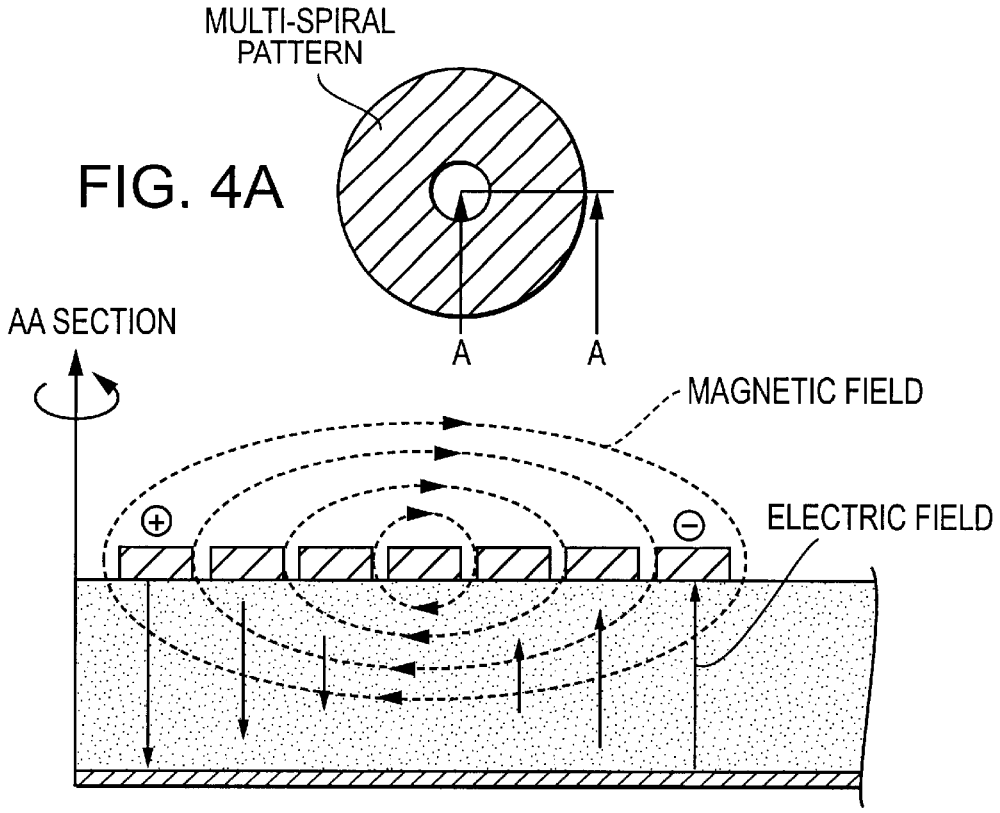
FIG. 4A
FIG. 4B
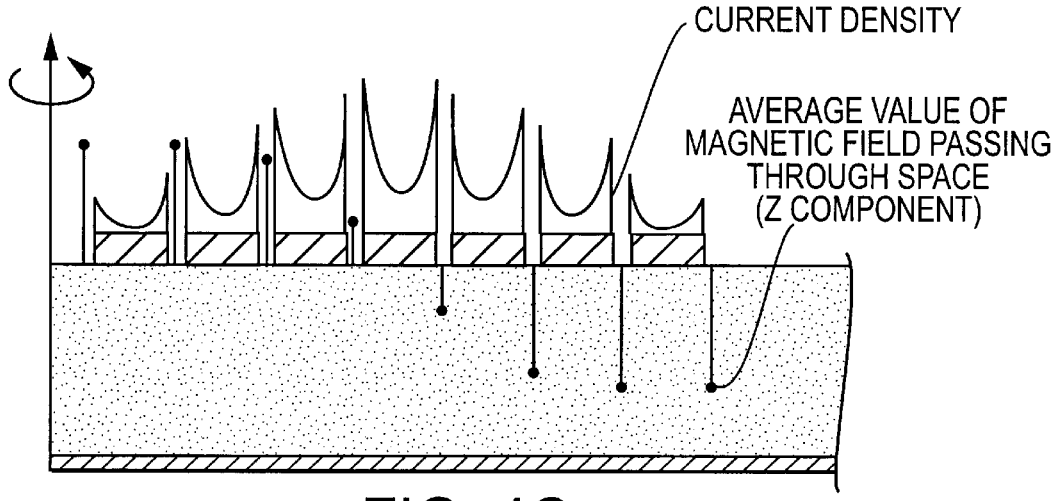
FIG. 4C
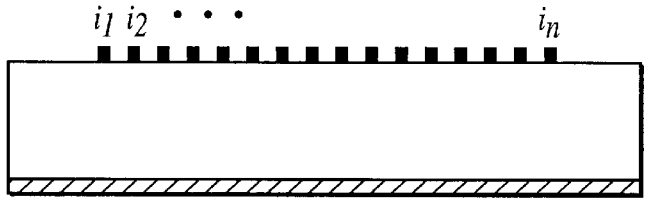
FIG. 5

SETTING CONDITIONS

| | |
|---|---|
| NUMBER OF LINES: | 8 |
| LINE: | 10.0μm |
| SPACE: | 10.0μm |
| MINIMUM RADIUS: | 25.5μm |
| MAXIMUM RADIUS: | 750.0μm |
| LENGTH OF LINE: | 11.0mm |

RELATIVE PERMITTIVITY 80

3 LINES WITH 24 ANGLES / 360°

4 LINES WITH 24 ANGLES / 360°

12 LINES WITH 24 ANGLES / 360°

24 LINES WITH 24 ANGLES / 360°

48 LINES WITH 24 ANGLES / 360°

RESONATOR, FILTER, DUPLEXER, AND COMMUNICATION DEVICE

BACKGROUND OF THE INVENTION

1. Field of the Invention

The present invention relates to resonators, and more particularly, resonators formed by collecting a plurality of spiral lines, for use in microwave or millimeter-wave band communications. In addition, the invention relates to filters, duplexers, and communication devices incorporating the resonator.

2. Description of the Related Art

As an example of a resonator for use in microwave bands and millimeter-wave bands, a hairpin resonator is described in Japanese Unexamined Patent Publication No. 62-193302. The size of the hairpin resonator can be reduced more than that of a straight-line resonator.

Additionally, another type of resonator capable of being made compact, a spiral resonator, is described in Japanese Unexamined Patent Publication No. 2-96402. In the spiral resonator, since a resonator line is formed of spiral shapes, a long resonant line can be arranged in a small area, with a resonant capacitor being provided as well, and a further reduction in the size of the resonator is achieved.

In the conventional resonator, since one resonator is formed by one half-wavelength line, an area where electrical energy concentrates and an area where magnetic energy concentrates are separately distributed on respective specified areas of a dielectric substrate. More specifically, the electrical energy is concentrated in proximity to the open-end portion of the half-wavelength line, and the magnetic energy is concentrated in proximity to the center thereof.

In such a resonator, an inevitable problem is a reduction in its characteristics due to an inherent edge effect of a micro-strip line. In other words, current concentrates in proximity to the external surface of the line. In this situation, since the current concentration occurs within a certain depth from the external surface of the line, even if the thickness of the line is increased, the problem of a power loss due to the edge effect cannot be solved.

SUMMARY OF THE INVENTION

Accordingly, in order to solve the problem described above, the present invention provides a resonator in which power losses due to the edge effect of a line are effectively suppressed. In addition, the invention provides a filter, a duplexer, and a communication device incorporating the resonator.

According to one aspect of the present invention, there is provided a resonator including a substrate and a set of lines comprising a plurality of spiral lines arranged thereon in such a manner that inner and outer ends of the spiral lines are distributed substantially along an inner periphery and an outer periphery of the set of lines respectively, the inner and outer peripheries being centered around a specified point on the substrate, and wherein the lines do not cross each other.

According to another aspect of the present invention, there is provided a resonator including a substrate and a set of lines comprising a plurality of spiral lines, each of the lines being in a position of rotational symmetry with respect to another spiral line. With this arrangement, when each line is seen in a cross-sectional view taken in the direction of the radius-vector (radius) of the set of lines, at the right and left sides of each spiral line, a line defining a point in each line through which current having substantially the same amplitude and phase flows through all of the lines is arranged at substantially a constant distance from a central point of the set of lines, with the result that an edge effect can be effectively suppressed.

According to another aspect of the present invention, there is provided a resonator including a substrate and a set of lines comprising a plurality of lines thereon, each line being indicated by a monotonically increasing or decreasing line in a polar-coordinate expression with one axis representing angles and the other axis representing radius vectors. Each line is arranged on the substrate in such a manner that the width of each line is within an angular width equal to or less than a value obtained by dividing $2\pi$ radians by the number of lines n, and the width of the overall set of the lines is constantly within an angular width of $2\pi$ radians or less at any arbitrary radius vector.

For instance, as shown in FIG. 2, when the position of the line is expressed in polar coordinates, in which the angle of the left end of a line at an arbitrary radius vector is $\theta_1$ and the angle of the right end thereof at an arbitrary radius vector is $\theta_2$, the angular width of the line is expressed by an equation $\Delta\theta=\theta_2-\theta_1$. In this case, when the number of the lines is n, the angular width $\Delta\theta$ of the line satisfies $\Delta\theta\ 2\pi/n$. In addition, the angular width $\theta_w$ of the overall set of the lines at an arbitrary radius vector $r_k$ is set to be $2\pi$ radians or less.

With such a structure, a spiral line having the same shape as that of any given spiral line is disposed adjacent thereto. As a result, microscopically viewed, physical edges of the line are actually present, and a weak edge effect is generated at the edges of each line. However, the set of lines can be macroscopically viewed as a single line, so to speak. The right side of any given line is adjacent to the left side of another line having the same shape as that of the given line. As a result, the edges of the line in the line-width direction effectively disappear; in other words, the presence of the edge of the line becomes blurred.

Therefore, since current concentration at the edges of the line is very efficiently alleviated, overall power losses can be suppressed.

Furthermore, in one of the resonators described above, an electrode to which the inward end portions of the lines are connected may be disposed at the center of the set of lines. With this structure, the inward end portions of the lines, which are the inner peripheral ends thereof, are commonly connected by the electrode to be at the same potential. As a result, the boundary conditions of the inward end portions of the lines are forcibly equalized, so that the lines steadily resonate in a desired resonant mode, whereas a spurious mode is suppressed at the same time.

Furthermore, in the resonator of another aspect of the present invention, the equipotential portions of adjacent lines may be mutually connected by a conductor member. This arrangement permits the operation of the resonator to be stabilized without any influence on the resonant mode.

Furthermore, in the resonator of another aspect of the present invention, one end portion or both end portions of each of the plural lines may be grounded to a ground electrode.

In this situation, when only one end of each line is grounded, the resonator is a ¼-wavelength resonator. Accordingly, the desired resonant frequency can be obtained with only a short line-length so that the overall size of the resonator can be reduced. In addition, when both end portions of each line are grounded, electric field components at the grounded parts are zero, with the result that a good shielding characteristic can be obtained.

Furthermore, in the resonator according to another aspect of the present invention, each of the plurality of lines may be formed of folded lines. With this arrangement, the lines can be formed by using a simple structure that is obtainable by using film forming and micro-processing methods.

Furthermore, in the resonator according to another aspect of the present invention, the widths of the-plurality of lines and the distance between adjacent lines may be substantially equal from one end portion of the lines to the other end portion thereof. With this structure, the size of the resonator can be minimized.

Furthermore, in the resonator according to another aspect of the present invention, the width of each of the plurality of lines may be substantially equal to or narrower than the skin depth of the conductor material of the line. With -this structure, magnetic fluxes penetrate into each conductor line from both sides of the line and interfere with each other. Such interference realizes an even phase of the current density in the line. This means that the amount of ineffective current having a phase out of resonant phase can be reduced.

Furthermore, in the resonator according to another aspect of the present invention, each of the plurality of lines may be a thin-film multi-layer electrode formed by laminating a thin-film dielectric layer and a thin-film conductor layer. With this structure, the skin effect from the substrate interface in the film-thickness direction can be alleviated, which leads to further reduction in the conductor losses.

Furthermore, in the resonator according to another aspect of the present invention, a dielectric material may be filled in a space between adjacent lines of the plurality of lines. This can prevents short circuits between the lines, and when the lines are the above-described thin-film multi-layer electrodes, short circuits between the layers can be effectively prevented.

Furthermore, in the resonator according to another aspect of the present invention, at least one of the plurality of lines may be formed of a superconducting material. Since the resonator of the present invention has a structure in which a large current concentration due to the edge effect basically does not occur, the reduced loss-characteristics of a superconducting material can be fully used so as to operate the resonator with a high Q, at a level equal to or lower than a critical current density.

Furthermore, in the resonator according to another aspect of the present invention, the plurality of lines may be disposed on both surfaces of the substrate, and the periphery of the substrate may be shielded by a conductive cavity. With this arrangement, the symmetric characteristics of a resonant-electromagnetic field can be satisfactorily maintained, by which lower loss-characteristics can be obtained.

According to another aspect of the present invention, there is provided a filter including one of the above-described resonators, including a signal input/output unit. This permits a compact filter having reduced insertion losses to be produced.

According to another aspect of the present invention, there is provided a duplexer including the above filter used as either a transmitting filter or a receiving filter, or as both of the filters. This provides a compact duplexer having low insertion losses.

According to another aspect of the present invention, there is provided a communication device including either the filter or the duplexer, which are described above. This arrangement permits the insertion losses in an RF transmission/reception unit to be reduced, with the result that communication qualities such as noise characteristics and transmission speed can be improved.

Other features and advantages of the present invention will become apparent from the following description of embodiments of the invention which refers to the accompanying drawings.

BRIEF DESCRIPTION OF THE DRAWINGS

FIGS. 1A to 1D show views of the structure of a resonator according to a first embodiment of the present invention, in which FIG. 1A is a top view of the resonator, FIG. 1B is a sectional view thereof, FIG. 1C is a view illustrating only one of eight lines shown in FIG. 1A, and FIG. 1D is a partially enlarged sectional view;

FIGS. 3A, 3B, and 3C are views illustrating examples of the electromagnetic-field distribution of the resonator, in which FIG. 3A is a plan view of a multi-spiral pattern indicated by black-shading the entire area of the lines without indicating them individually; FIG. 3B shows the distribution of an electric field and the distribution of a magnetic field on a section taken along a line A—A of the multi-spiral pattern viewed at the moment when the electric field at the inner peripheral ends and outer peripheral ends of the lines is at a maximum; and FIG. 3C indicates the current density in each line in a view taken along at the same moment as the section line A—A shown in FIG. 3B and average values of z components of magnetic fields passing through the spaces between the lines, namely, in directions vertical to the drawing surface;

FIGS. 4A to 4C are views illustrating an example of the electromagnetic-field distribution of another resonator;

FIG. 5 is an analysis model of a magnetic-field distribution made by a line current source;

FIGS. 11A to 11C show views of the structure of a resonator according to a second embodiment of the present invention, in which FIG. 11A is a plan view of the resonator, FIG. 11B is a sectional view thereof, and FIG. 11C is a partially enlarged sectional view thereof;

FIGS. 12A to 12C show views of the structure of a resonator according to a third embodiment of the present invention, in which FIG. 12A is a plan view of the resonator, FIG. 12B is a sectional view thereof, and FIG. 12C is a partially enlarged sectional view thereof;

FIGS. 13A to 13C show views of the structure of a resonator according to a fourth embodiment of the present invention, in which FIG. 13A is a plan view of the resonator, FIG. 13B is a sectional view thereof, and FIG. 13C is a partially enlarged sectional view thereof;

FIGS. 19A to 19C show views illustrating the structure of a resonator according to a seventh embodiment of the present invention, in which FIG. 19A is a top view showing the pattern of lines formed on a substrate, FIG. 19B is a sectional view of the overall resonator, and FIG. 19C is a partially enlarged view thereof;

FIGS. 25A to 25E show views illustrating the structures of other resonators according to the eleventh embodiment of the present invention, in which FIG. 25A is an example of an equipotential connecting line disposed at the outer periphery of a multi-spiral pattern, as a voltage antinode, FIG. 25B is an example of an equipotential connecting line disposed at the inner periphery thereof as a voltage antinode; FIG. 25C is an example of equipotential connecting lines disposed both at the inner periphery and outer periphery thereof; FIG. 25D is an example of an equipotential connecting line disposed at a certain position thereof as a voltage node; and FIG. 25E is an example of equipotential connecting lines disposed both at the inner periphery and outer periphery thereof as voltage antinodes and at a certain position as a voltage node;

FIGS. 27A and 27B show views of the structures of a filter according to a thirteenth embodiment of the present invention, in which FIG. 27A is a top view of a dielectric substrate on which multi-spiral patterns are formed, and FIG. 27B is a front view of the overall filter;

FIGS. 31A to 31C are views illustrating the structures of a resonator according to a sixteenth embodiment of the present invention, in which FIG. 31A is a plan view of the resonator, FIG. 31B is a sectional view thereof, and FIG. 31C is a partially enlarged sectional view thereof;

FIGS. 32A to 32C are views illustrating the structures of a resonator according to a seventeenth embodiment of the present invention, in which FIG. 32A is a plan view of the resonator, FIG. 32B is a sectional view thereof, and FIG. 32C is a partially enlarged sectional view thereof;

FIGS. 33A to 33C show views illustrating the structures of a resonator according to an eighteenth embodiment of the present invention, in which FIG. 33A is a plan view of the resonator, FIG. 33B is a sectional view thereof, and FIG. 33C is a partially enlarged sectional view thereof;

FIGS. 34A to 34C show views illustrating the structures of a resonator according to a nineteenth embodiment of the present invention, in which FIG. 34A is a plan view of the resonator, FIG. 34B is a sectional view thereof, and FIG. 34C is a partially enlarged sectional view thereof.

DESCRIPTION OF EMBODIMENTS OF THE INVENTION

Figure 1C:
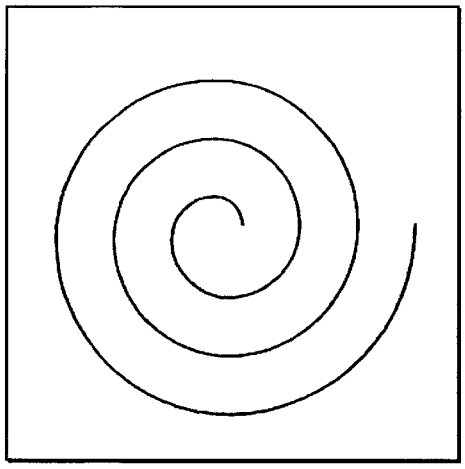
Figure 1A:
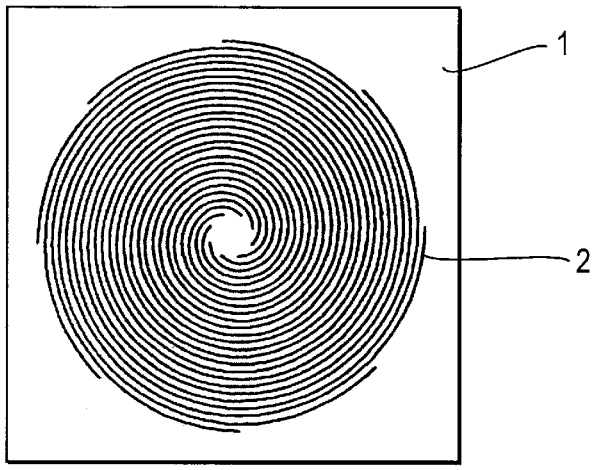
Figure 1B:
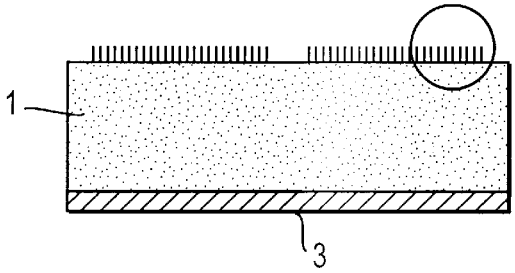
Figure 1D:
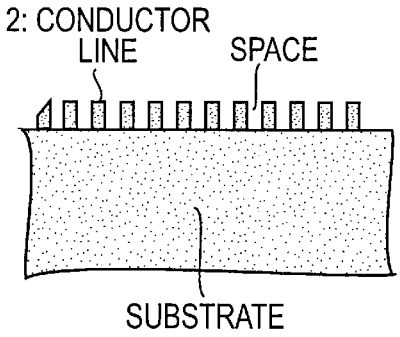

Referring to the drawings, a description will be given of embodiments of a resonator, a filter, a duplexer, and a communication device in accordance with the present invention.

[Principle and First Embodiment: FIGS. 1 to 10]

A ground electrode 3 is formed on the entire lower surface of a dielectric substrate 1. On the upper surface of the dielectric substrate 1, eight spiral lines 2 having the same shapes, both ends of the lines being open, are disposed in such a manner that the spiral lines do not cross each other. One end of each of the lines is disposed around an area where no lines are present, which is equivalent to the center of a spiral shown in FIG. 1A, as the central part of the substrate 1. Only one of the lines is indicated in FIG. 1C in order to simplify the illustration. Preferably, the width of the lines is substantially equal to the skin depth of the conductor material of the line.

Figure 2:
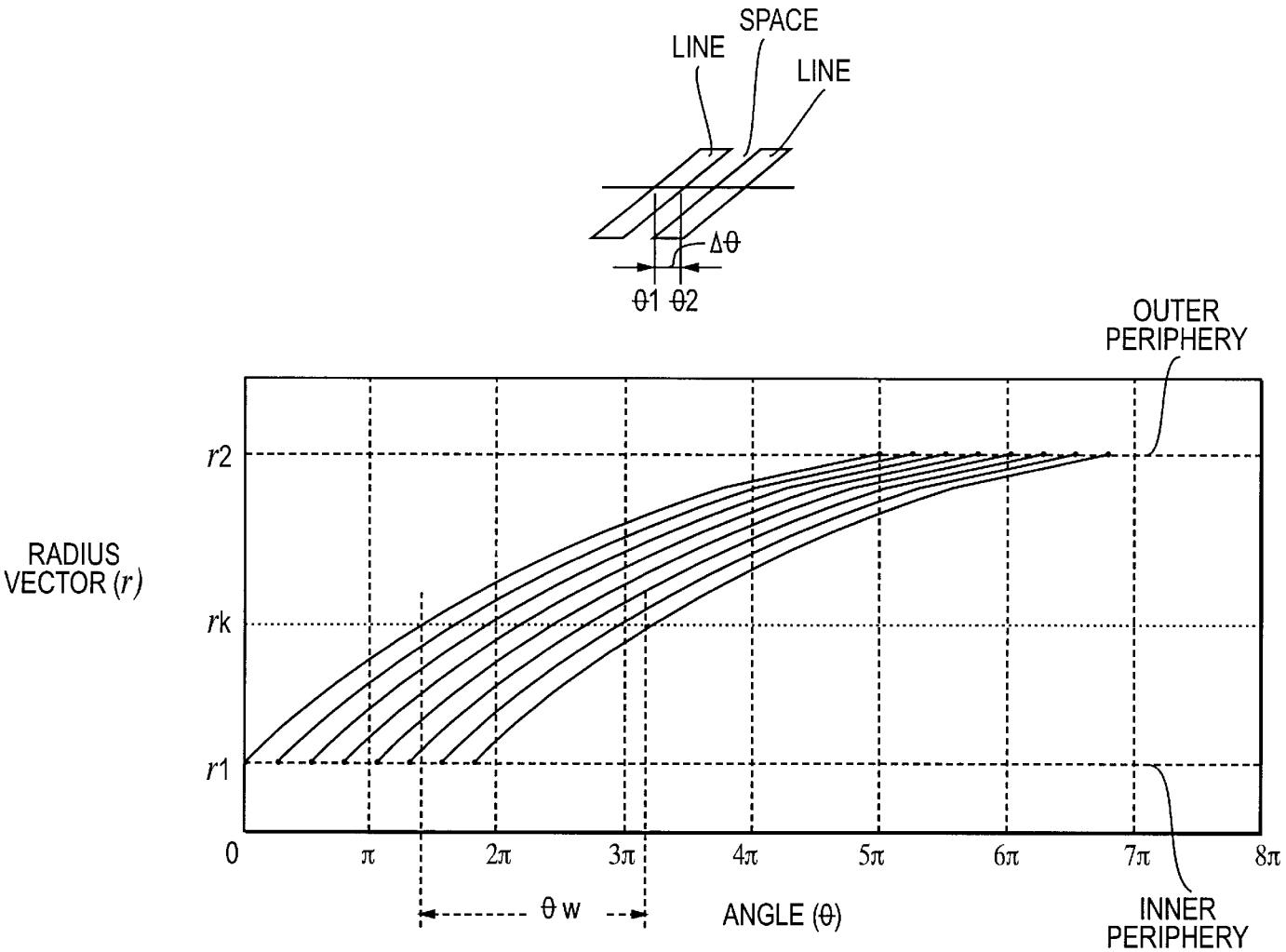
FIG. 2 is a view of the lines in the resonator, in which the patterns of the lines are indicated by arranging polar coordinates in a rectangular arrangement.

FIG. 2 is a graph in which the shapes of the eight lines shown in FIG. 1 are indicated by polar coordinates. In this case, a radius vector $r_1$ of the inner peripheral end and a radius vector $r_2$ of the outer peripheral end of each of the eight lines are fixed, and the positions in the angle directions of the end portions of the lines are spaced uniformly. As described above, when the angle of the left end of each line at an arbitrary radius vector is $\theta_1$ and the angle of the right end thereof at an arbitrary radius vector is $\theta_2$, the angular width of the line is expressed by an equation $\Delta\theta = \theta_2 - \theta_1$. In this situation, since the number of the lines is 8, the angular width $\Delta\theta$ of one of the lines satisfies $\Delta\theta \leqq 2\pi/8$ ($=\pi/4$) radian. In addition, the angular width $\theta_w$ of the overall set of lines at an arbitrary radius vector $r_k$ is set to be $2\pi$ radians or less.

These lines are coupled by mutual inductance and capacitance to serve as a single resonator, which is a resonant line.

The radius vectors $r_1$ and $r_2$ are not necessarily fixed, and they are not required to be disposed at a-uniform angle. In addition, the shapes of the lines are not necessarily the same. However, as will be described below, in terms of aspects of characteristics and easy manufacturing, preferably, the radius vectors $r_1$ and $r_2$ are fixed and lines having the same shapes are disposed at uniform angles.

Figure 3A:
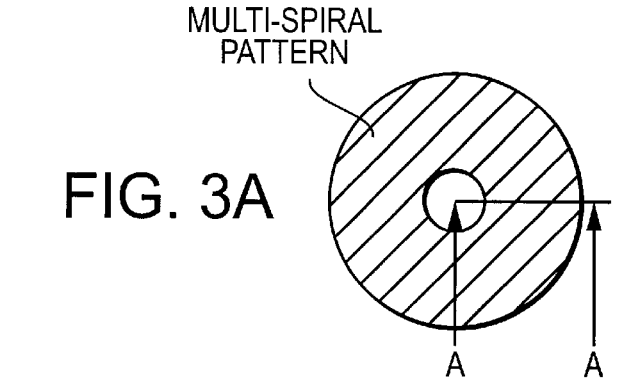
Figure 3B:
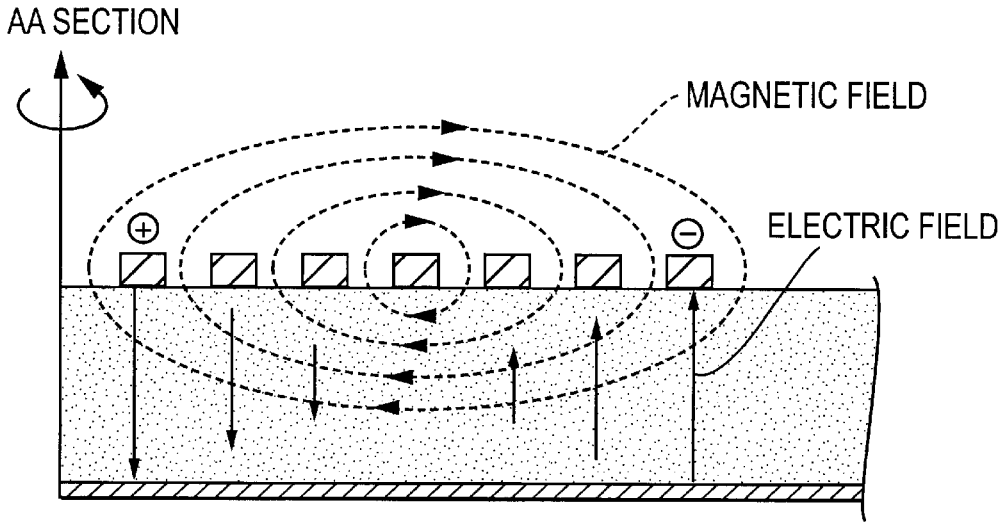
Figure 3C:
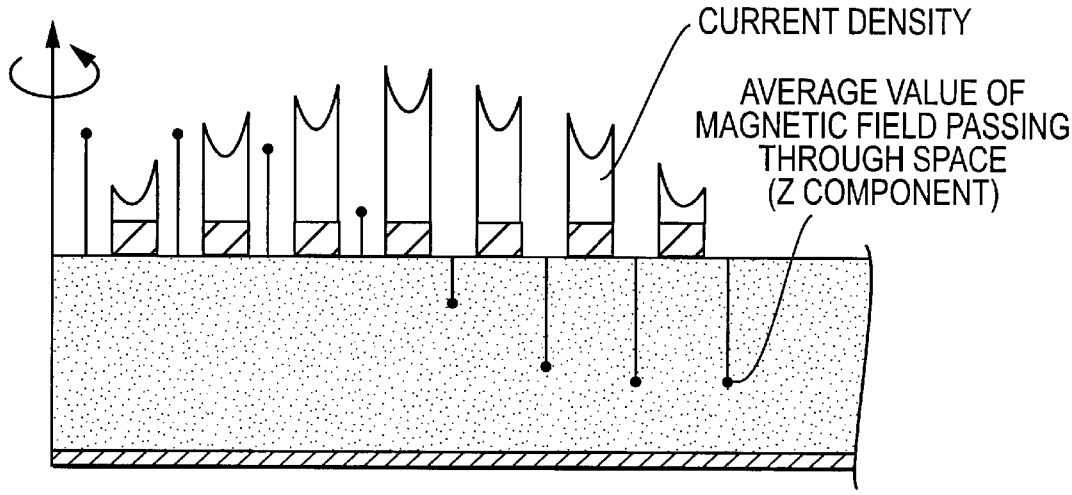

FIGS. 3A to 3C show examples of the distributions of an electromagnetic field and current in the set of a plurality of spiral lines, which is referred to as a multi-spiral pattern.

Each line has larger current density at the edges thereof. When seen in a horizontal sectional view in the spiral radius-vector direction, since another conductor line through which current having the same level of amplitude and phase flows is disposed at the right and left sides of a spiral line at a fixed spacing, the edge effect of the line can be alleviated. In other words, when the multi-spiral pattern is regarded as a single line, the inner peripheral end and the outer peripheral end of the single line are equivalent to the nodes of current distribution and the center thereof is equivalent to the antinode of current distribution, in which current is distributed in a sine-wave form. As a result, macroscopically, no edge effect occurs.

FIGS. 4A–4C show an example for comparison, in which the width of each line shown in FIGS. 3A–3C is increased to the width of two or three times the skin depth of the line. When the width of the line is increased as described above, current concentration due to the edge effect of each conductor line noticeably appears as shown in FIG. 4C, which leads to an increase in power losses due to the edge effect.

Although the electromagnetic-field-distributions as shown in FIGS. 3A–4C cannot be obtained without performing a three-dimensional analysis, since the calculating process is huge, it is difficult to perform a precise analysis. The case below describes the result of a static magnetic-field analysis regarding magnetic distributions made by a plurality of line current sources having amplitudes and phases.

(Analysis Model)

FIG. 5 shows an analysis model of plural line current sources, which is indicated by a sectional view of a plurality of micro-strip lines. In the following equations, A represents amplitude.

Model 1 (a model in which current is distributed at the same phase and amplitude)

$$i_k = A/\sqrt{2},\ (k=1, 2, \ldots n)$$

Model 2 (a model in which current is distributed between 0° and 180° phases with a sine-wave amplitudes curve)

$$i_k = A\sin\{(2k-1)\pi/2n\},\ (k=1, 2, \ldots n)$$

(Calculation of Magnetic-Field Distribution)

The calculation of a magnetic-field distribution in the section is performed according to the Biot-Savart law.

The equation below shows a magnetic-field vector made by a source of line current continuing to flow unlimitedly in the z-direction after passing a coordinate p given by the axes x and y.

[EQUATION 1]

$$H = \frac{\mu_0 I_0 e_z \times (r-p)}{4\pi(r-p)^2}$$

In this analysis model, the magnetic-field distribution made by the plural line current sources is obtained by the following equation.

[EQUATION 2]

$$H = \sum_K \frac{\mu_0 i_k}{4\pi}\left(\frac{e_z \times (r-p_k)}{(r-p_k)^2} - \frac{e_z \times (r-p_k^{(m)})}{(r-p_k^{(m)})^2}\right)$$

In this situation, $P_k^{(m)}$ is a coordinate at a position reflecting $P_k$ with respect to the ground electrode as a symmetry surface. In addition, since current flows in reverse, the second term has a negative sign.

(Example of Calculation)

Setting Conditions:

Number of lines n=20

Total line width $w_o$=0.5 mm

Height of substrate: $h_o$=0.5 mm

Coordinates of line current source $$x_k = [\{(2k-1)/2n\} - (½)]w_o$$

$$y_k = h_o\ (k=1, 2, \ldots, n)$$

Figure 6A:
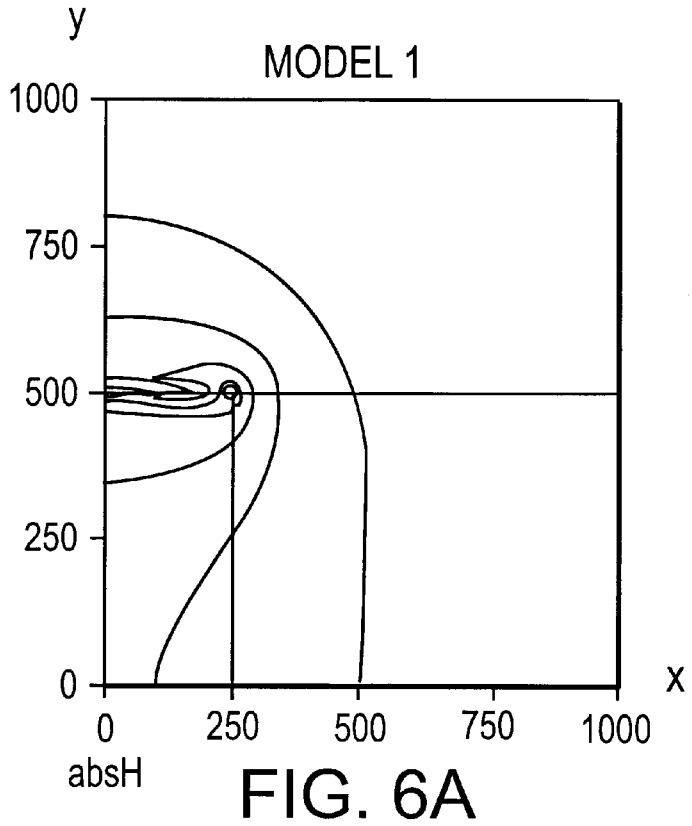
FIGS. 6A and 6B show graphs illustrating magnetic-field-density distributions in two analysis models.
Figure 6B:
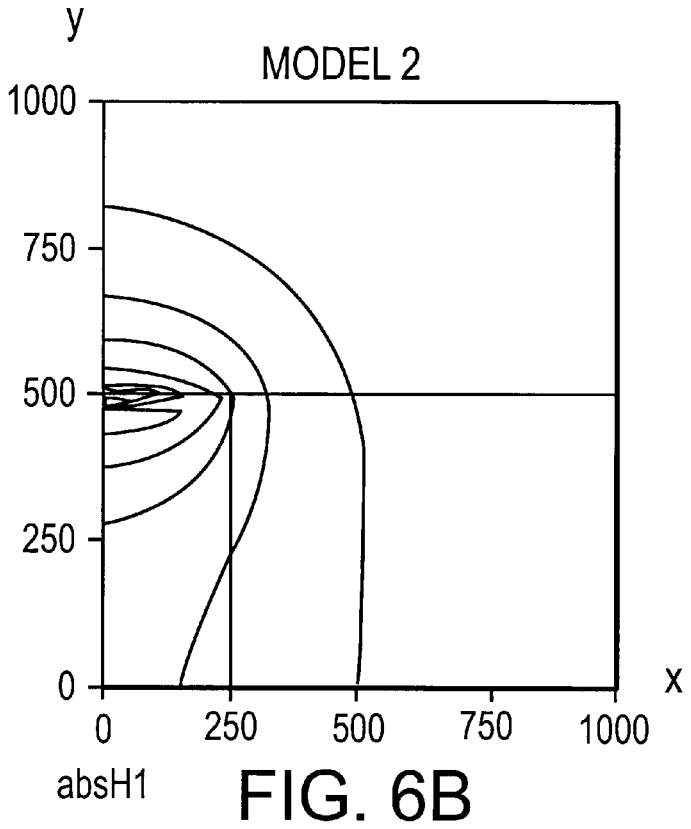

FIGS. 6A and 6B show the strength of a magnetic-field distribution in the models 1 and 2, respectively. In the figures, additional lines in the longitudinal direction indicate the end portion of a set of multiple lines, and additional lines in the lateral direction indicate a substrate interface. The result shows that in model 2 with a sine distribution, contour lines are less closely-crowded both in the x and y directions. Eventually, it can be understood that, while both models 1 and 2 have equal amounts of magnetic-field charging energy, model 2 has a smaller surface current, by which less power loss is achieved.

Figure 7A:
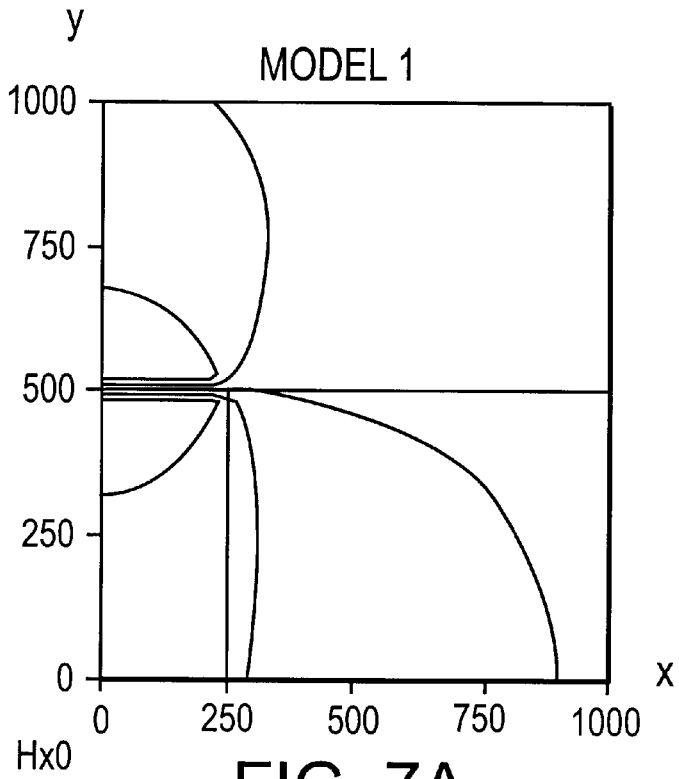
FIGS. 7A and 7B show graphs illustrating the distributions of the x components of the magnetic-field amplitudes in the models.
Figure 7B:
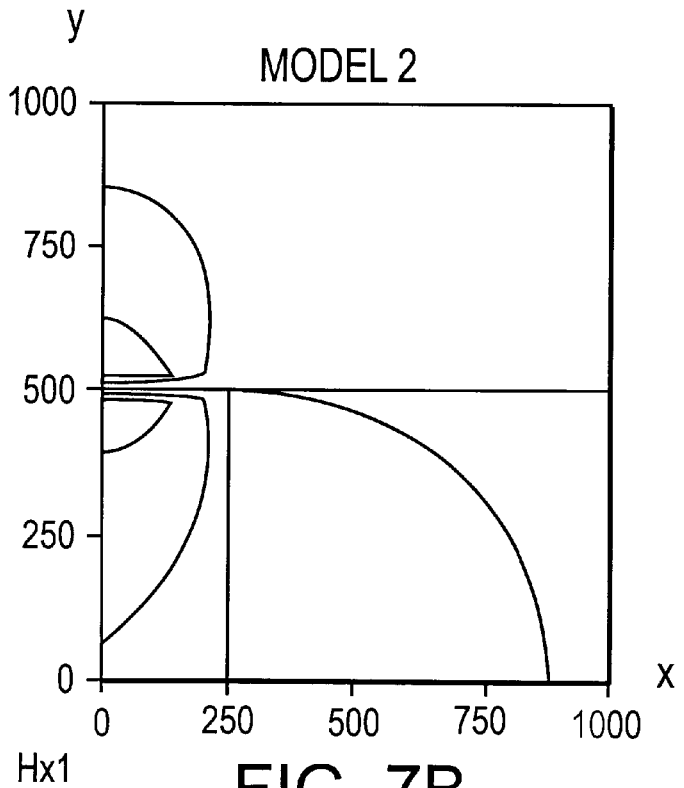

FIGS. 7A and 7B show the distribution of an x component of the magnetic field in models 1 and 2, respectively. In this figure, additional lines in the longitudinal direction indicate the end portion of a set of multiple lines, additional lines in the lateral direction indicate a substrate interface. The figures show that, compared to model 1, since isolation in model 2 is more satisfactory, model 2 is more suitable for integration of components including a case where a filter is formed by arranging adjacent resonators.

Figure 8A:
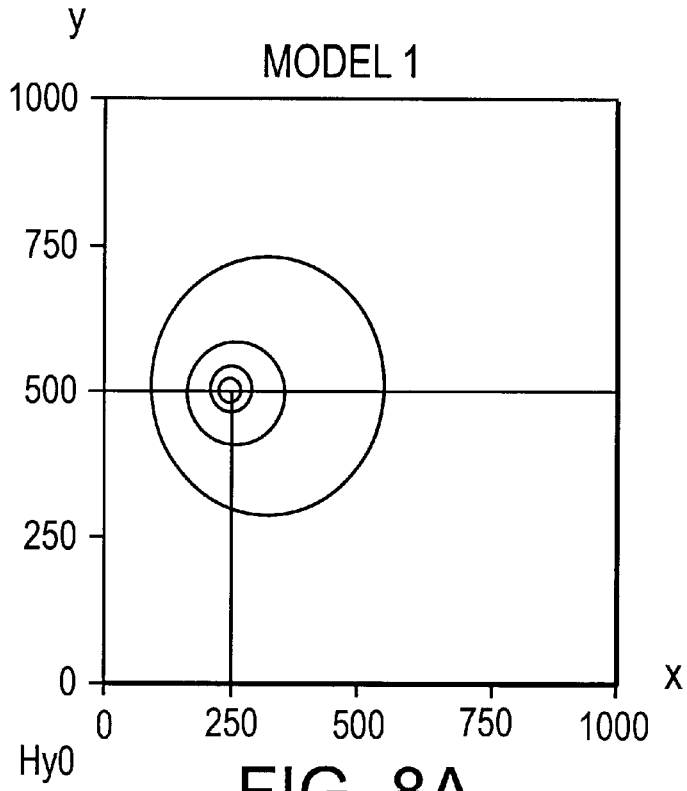
FIGS. 8A and 8B show graphs illustrating the distributions of the y components of the magnetic-field amplitudes in the models.
Figure 8B:
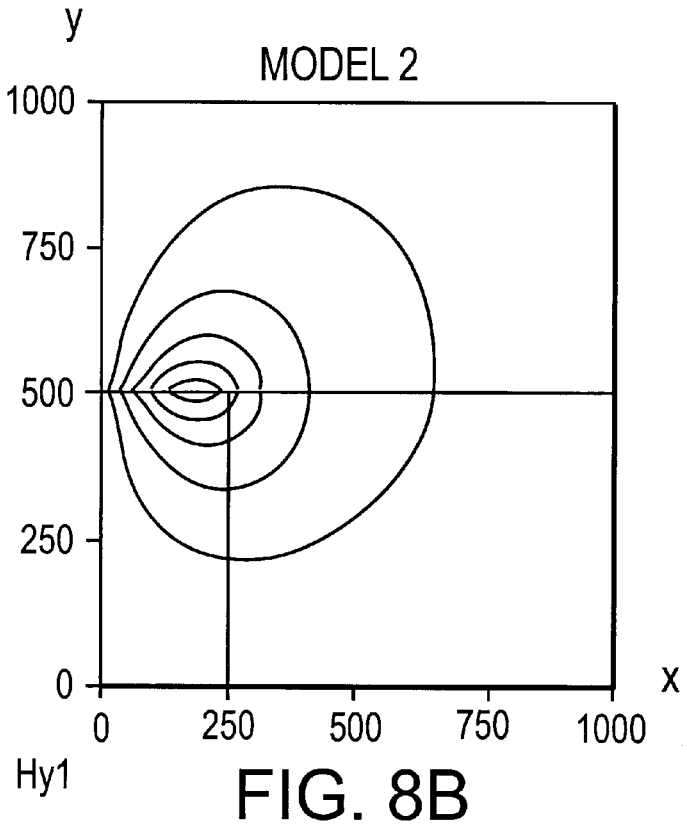
Figure 9:
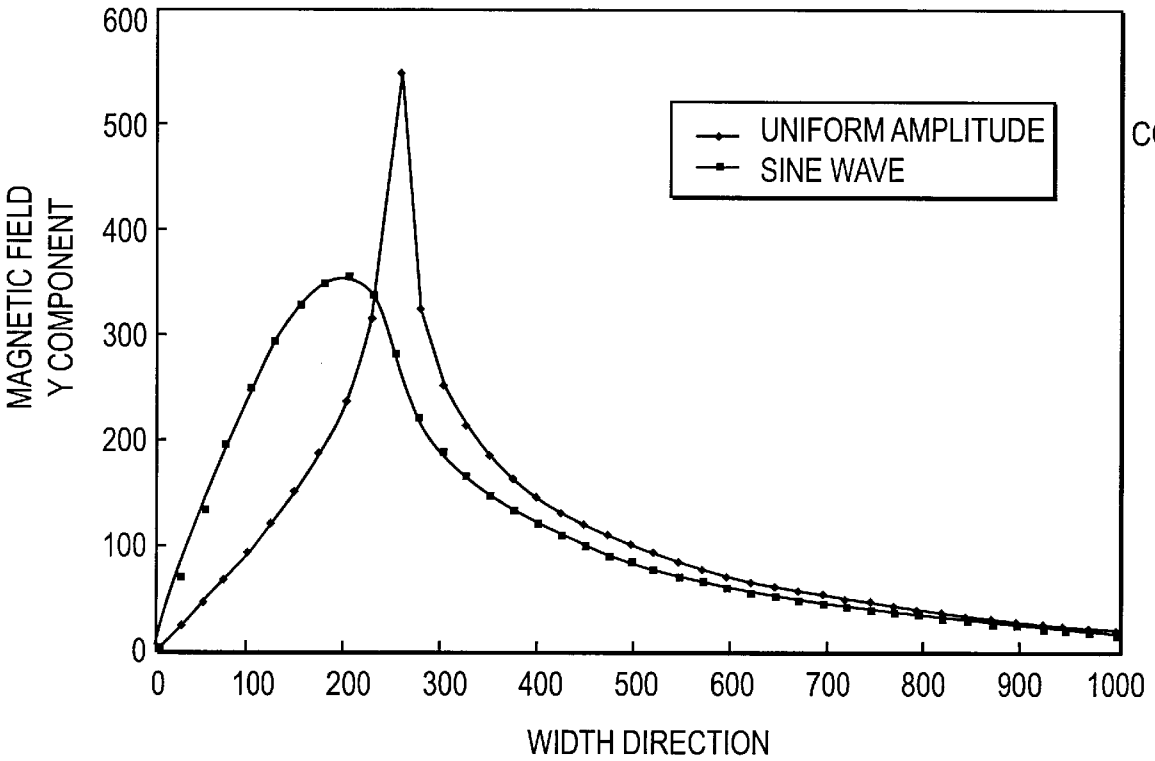
FIG. 9 is a graph showing the strength of the y component of a magnetic field versus the position in the x-direction.

FIGS. 8A and 8B show the secondary distribution of a y component of the magnetic field in models 1 and 2, respectively, and FIG. 9 shows the primary distributions thereof. In FIGS. 8A and 8B, additional lines in the longitudinal direction indicate the end portion of a set of multiple lines, and additional lines in the lateral direction indicate a substrate interface. This result shows that model 2 gives less magnetic-field concentration at the electrode edges, by which the edge effect of the lines is greatly improved and better loss characteristics are thereby obtainable.

Figure 10:
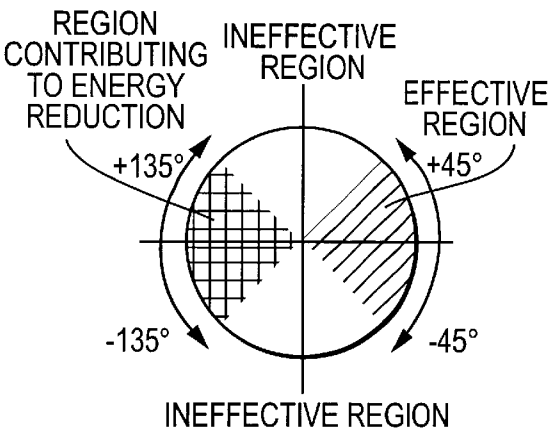
FIG. 10 is a chart illustrating the relationship between the current-phase difference between adjacent lines and an energy-charging effective area.

The edge-effect suppressing result obtained by the multi-spiral pattern as described above can be revealed most obviously in a case where, at an arbitrary point on a line, the current-phase differences between the line and adjacent lines to the right and the left disposed closest to the line are the smallest. FIG. 10 shows the relationship between the above phase difference and the conductor loss. In this situation, when the current-phase differences between a line and the adjacent lines are 0°, resonant energy can be most effectively maintained. When the phase differences are ±90°, reactive current prevents reduction of conductor loss. The reactive current occurring in this case is current (density) whose phase deviates from the magnetic field of a resonator, and the reactive current does not contribute to transmission. When the current-phase differences are further increased to be ±180°, resonant energy is reduced. As a result, the current-phase differences in the range of substantially ±45° can be regarded as an effective area.

Therefore, the principles for designing a plane-circuit-type low-loss resonator using a multi-spiral pattern will be summarized as follows:

(1) A plurality of lines having the same shape are disposed in a rotation-symmetric form in such a manner that the lines are insulated from each other.

With this arrangement, the physical lengths, electrical lengths, and resonant frequencies of the lines are the same. In addition, equal phase lines present on a substrate interface are distributed in a concentric-circle form. As a result, from an electromagnetic viewpoint, a mode with no edges is provided, by which power losses due to the edge effect of the lines can be effectively suppressed.

(2) At an arbitrary point on each line, the phase differences between the line and adjacent lines to the right and the left at the nearest distance therefrom are set to be the smallest.

However, the widths of lines and the spaces between the lines are substantially fixed and are arranged as narrowly as possible. In addition, there is no sharp bend on the lines so as to avoid a situation in which a bent part of a line is adjacent to another part thereof.

With this arrangement, an electric-field vector occurring in the space between the lines and magnetic flux density passing through the space are smaller, which leads to a reduction in losses due to electrical power propagating through the space between the lines. In other words, this effectively serves to suppress the edge effect of each single line at a microscopic level.

(3) The width of each line is set to be substantially equal to or less than the skin depth of the line.

With this arrangement, magnetic-field intrusions from the right and left edges of a line mutually interfere, by which a conductor section area where effective current flows is increased and reactive current flowing through the line is thereby decreased, with the result that conductor losses can be reduced.

[Second Embodiment]

Figure 11A:
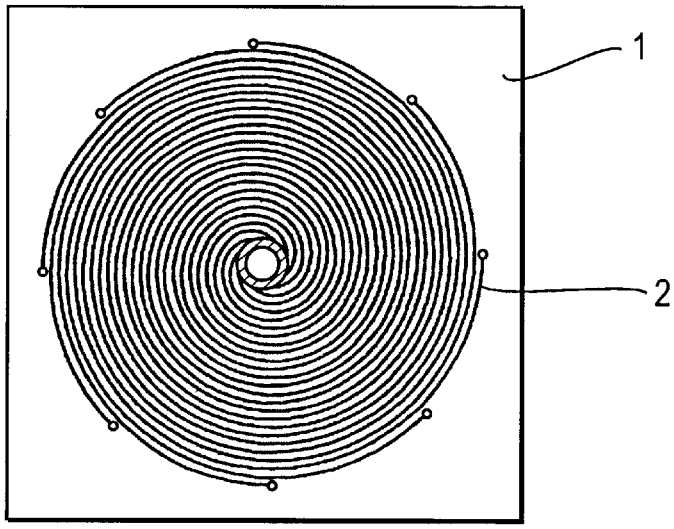
Figure 11B:
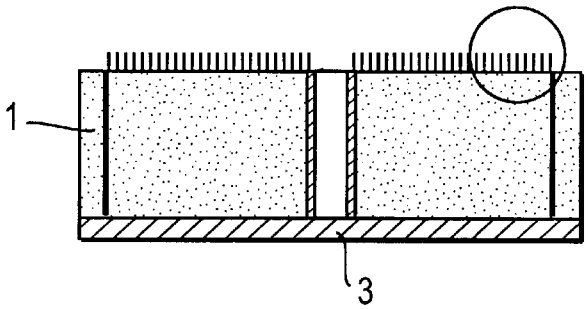
Figure 11C:
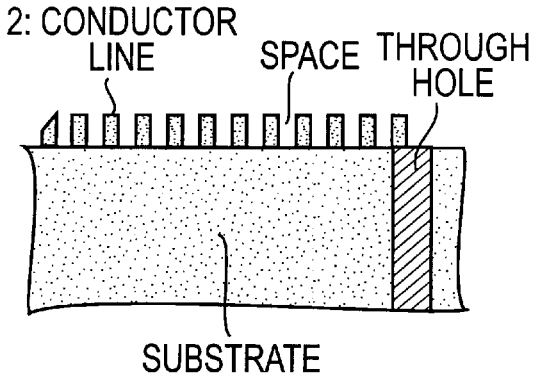

In the second embodiment shown in FIGS. 11A to 11C, the inner peripheral end and outer peripheral end of each line 2 formed of a multi-spiral pattern on a substrate 1 are grounded to a ground electrode 3 via a through-hole. This allows the line to serve as a resonant line whose two ends are short-circuited. In this structure, since both ends of the resonant line are short-circuited, the resonator has a good shielding characteristic, by which it is not very susceptible to electromagnetic leakage to the outside and influences due to external electromagnetic fields.

[Third Embodiment]

Figure 12A:
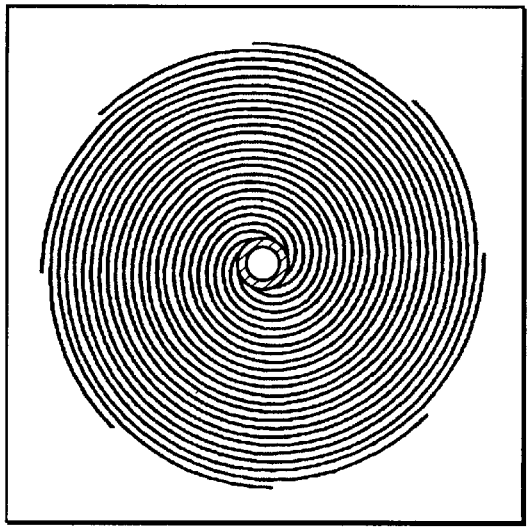
Figure 12B:
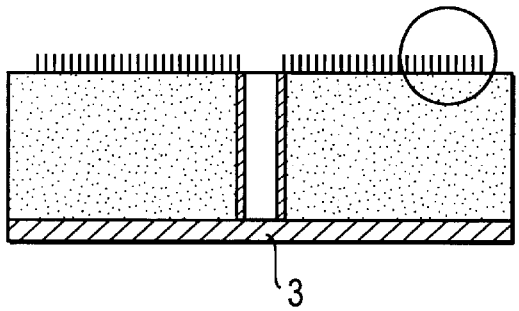
Figure 12C:
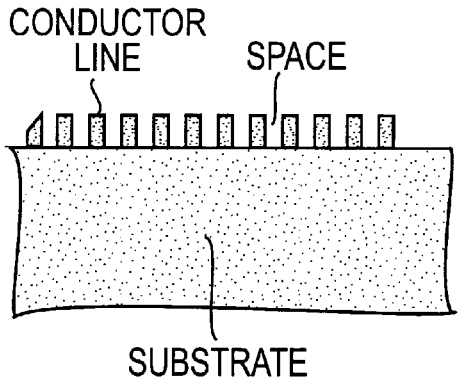

In the third embodiment; shown in FIGS. 12A to 12C, the inner peripheral end of each line of a multi-spiral pattern is grounded to a ground electrode 3 via a through-hole. The outer peripheral end thereof is open. This arrangement permits the lines to serve as a ¼-wavelength resonator. Since the resonator can provide a desired resonant frequency with, a short line length, the area occupied by the resonator on a substrate can be further reduced.

[Fourth Embodiment]

Figure 13A:
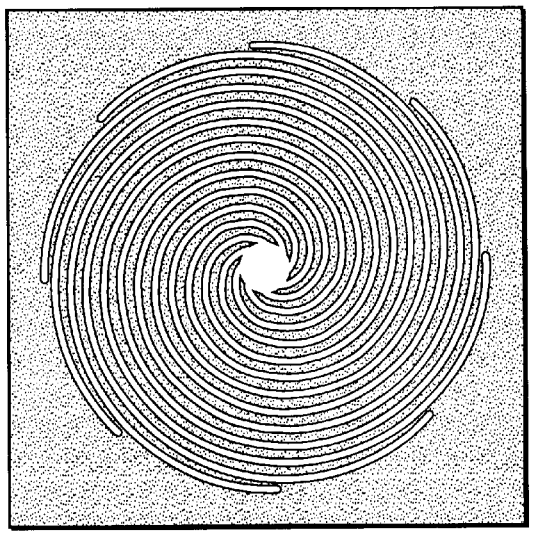
Figure 13B:
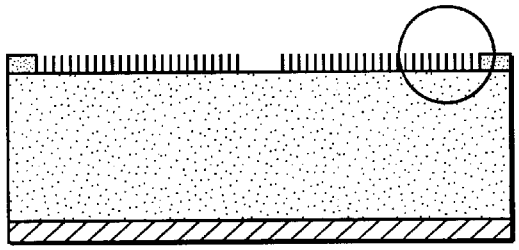
Figure 13C:
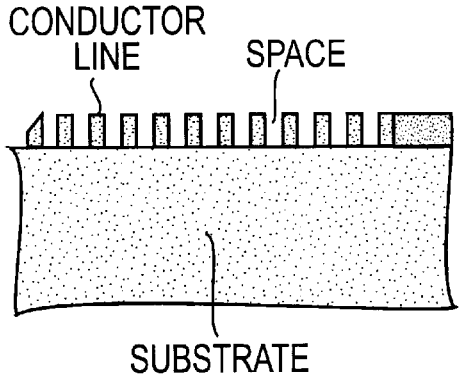

In the fourth embodiment indicated by FIGS. 13A to 13C, a multi-spiral pattern is formed of slot lines.

[Fifth Embodiment]

Figure 14:
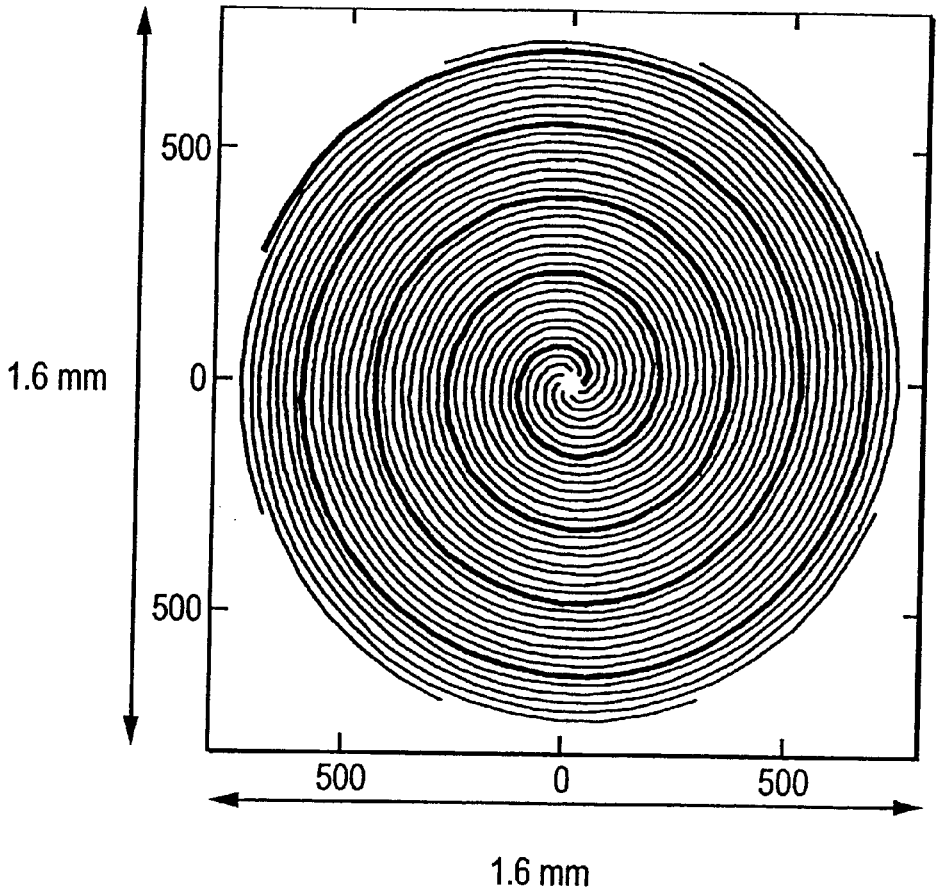
FIG. 14 is a view showing the structure of a resonator according to a fifth embodiment of the present invention.

FIG. 14 is an example of a multi-spiral pattern in which the spaces between adjacent lines are uniformly fixed to make spiral curves with equal widths. This example uses eight lines, a representative one of which is shown wider than the other lines. In this case, the area occupied by the multi-spiral pattern is set to be 1.6 mm×1.6 mm, the width of each line and the spaces between lines are each set to be 10 μm, the minimum inner peripheral radius is set to be 25.5 μm, the maximum outer peripheral radius is set to be 750.0 μm, the length of each line is set to be 11.0 mm, and the relative permittivity of the substrate is set to be 80. Under these setting conditions, when 60% of the relative permittivity operates as an effective value, the resonant frequency of the resonator is approximately 2 GHz.

A description will be given below of a procedure for the derivation of an equal-width multi-spiral which has an n-turn rotational symmetry.

(1) The number of lines n is given.

(2) The distance, that is, the width Δw in a radius direction which increases by rotating by a rotation angle $\Delta\theta=2\pi/n$ is given.

(3) The minimum radius $r_o=\Delta w/\Delta\theta$ determined by the above conditions is given.

(4) Dimensionless parameters u(r) and v(r), which are determined by the radius, are defined by the following equations.

$$u(r)=r/r_o$$

$$v(r)=\sqrt{(u(r)^2-1)}$$

(5) The coordinates of the equal-width spiral curve are expressed by the following equations in polar coordinates.

Right winding: $\theta(r)=v(r)-\tan^{-1}(v(r))$

Left winding: $\theta(r)=-v(r)+\tan^{-1}(v(r))$ (6) An inner peripheral radius ($r_a$) and an outer peripheral radius ($r_b$) satisfy the condition $r_o \leqq r_a < r_b$.

(7) The following equations provide the x and y coordinates by using a radius r ($r_a \leqq r \leqq r_b$) as a parameter.

x coordinate: $x_1(r)=r\cos(\theta(r))$ y coordinate: $y_1(r)=r\sin(\theta(r))$ (8) The x and y coordinates of the rest spiral n−1 are obtained by the following equations.

x coordinate: $x_k(r)=r\cos(\theta(r)+\Delta\theta\cdot(k-1))$ y coordinate: $y_k(r)=r\sin(\theta(r)+\Delta\theta\cdot(k-1))$ where (k=2, 3, . . . , n)

(9) Setting of resonant frequency

The length of a line, which is equivalent to a desired resonant frequency, is obtained by an effective value of the relative permittivity of a substrate, and the outer-peripheral radius $r_b$ is obtained so as to coincide with the calculated line length $L_{total}$.

Line length:

$$L_{total} = S_{ra}^{rb} r\cdot(d\theta(r)/dr)dr$$

$$= S_{ra}^{rb}\sqrt{\{(r/r_0)^2-1\}}dr$$

Although the sizes obtained by the above equations are most preferable, slightly different-values from those obtained by the calculation can also be used from a practical viewpoint.

Figure 15:
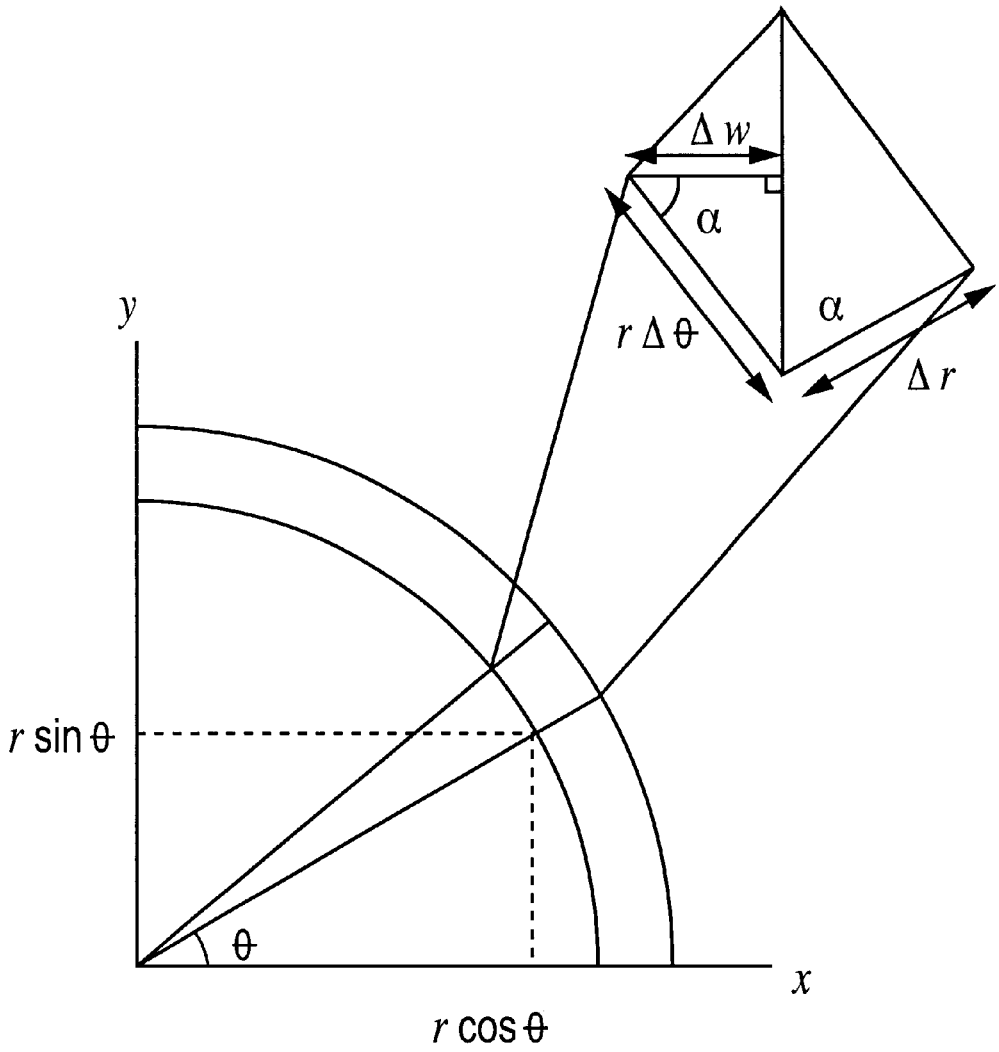
FIG. 15 is a reference view illustrating the derivation of a line pattern of the resonator.

Next, the derivation of the equal-width spiral curve will be illustrated below. FIG. 15 shows the relationship between parameters in the equations below.

(Setting conditions of an analysis model)

Number of equal-width spiral lines: n

Width (line width and space between lines) increasing during a 1/n rotation: Δw (1) Angle of a 1/n rotation $$\Delta\theta=2\pi/n$$

(2) Definition of a radius constant $r_o$ $$r_o=\Delta w/\Delta\theta$$

(3) Differential relational expressions $$rd\theta/dr=\tan\alpha$$

$$dw/(rd\theta)=\Delta w/(r\Delta\theta)=r_o/r=\cos\alpha$$

(4) Polar coordinate differential equation $$d\theta=\sqrt{\{(r/r_o)^2-1)\}}\ dr/r$$

(5) Variable conversion (introduction of dimensionless parameters).

When $u=r/r_o$ is set, an equation $d\theta=\sqrt{(u^2-1)}\ du/u$ is obtained. When $v=\sqrt{(u^2-1)}=\sqrt{\{(r/r_o)^2-1)\}}$, an equation $d\theta=\{v^2/(v^2+1)\}\ dv$ is obtained.

(6) Solution to the differential equation $$\theta=v-\tan^{-1}v$$

[Sixth Embodiment]

Figure 16:
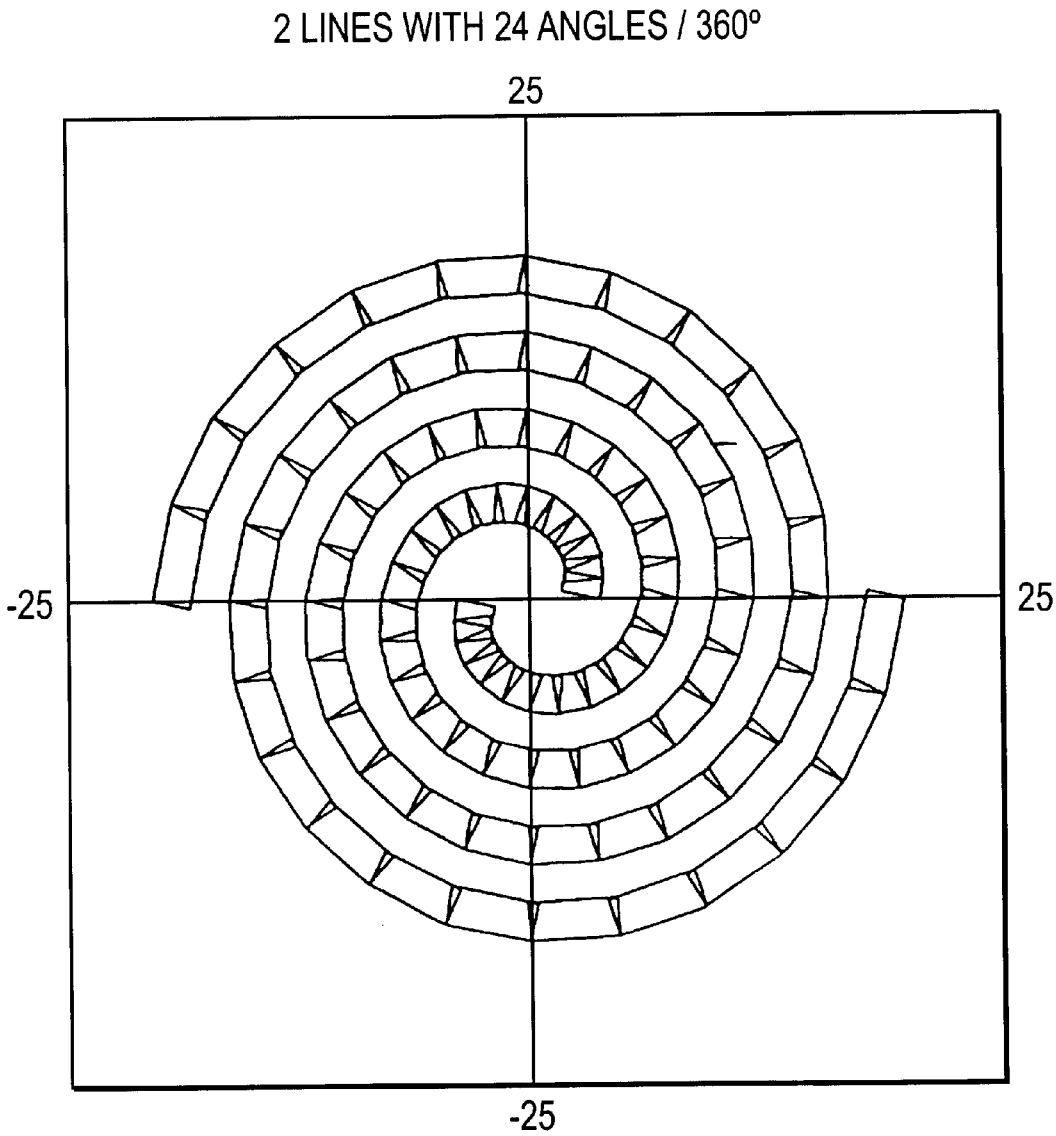
FIG. 16 is an illustration showing an example of the line pattern of a resonator according to a sixth embodiment of the present invention.

Although the first to fifth embodiments adopt curved lines, it is also possible to use a set of straight lines, which is a set of folded lines. FIG. 16 is an example where two lines are each formed of folded lines with 24 angles for each 360 degrees. As shown in the figure, in order to make the line widths and the spaces between adjacent lines equal, when the folded lines are bent at an equal-angle distance, it is substantially equivalent to the equal-width spiral curve.

In FIG. 16, each spiral line is represented by a combination of several successive rectangles. Portions where two rectangles are overlapped are represented by wedge-shapes. A photo-masking process which may be used for forming the spiral lines proceeds according to the rectangles. The resultant spiral line is an even line, i.e., the pattern of wedges is not observed.

In the process for producing the spirals, first a resist pattern is formed by photolithography for example and a spiral electrode pattern is formed by plating, or a liftoff process or the like. $ZrO_2$—$SnO_2$—$TiO_2$ based dielectric material or $Al_2O_3$ may be used for the dielectric substrate. Any metals can be used for the spiral electrode. Cu or Au are preferable.

Figure 17A:
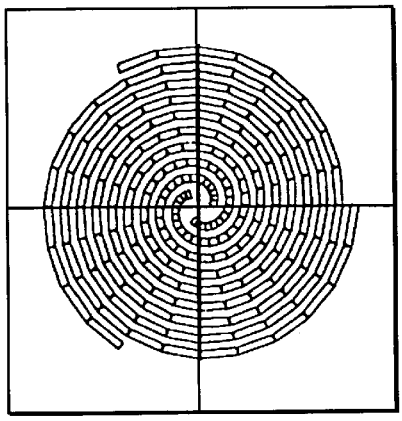
FIGS. 17A to 17E are illustrations showing other examples of the line patterns of the resonator according to the sixth embodiment.
Figure 17B:
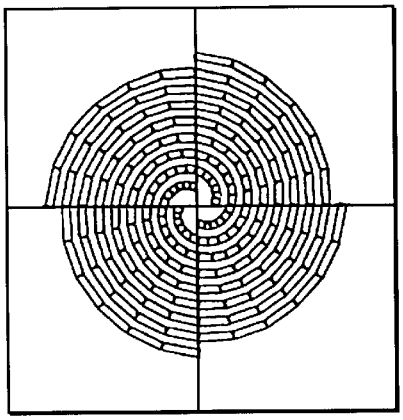
Figure 17C:
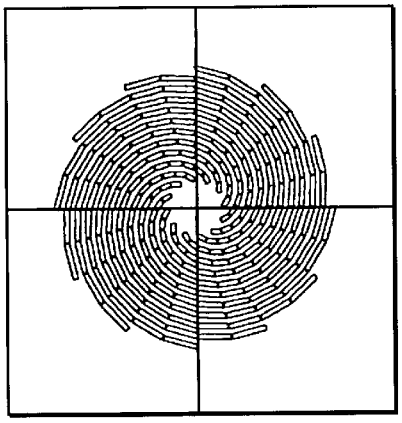
Figure 17D:
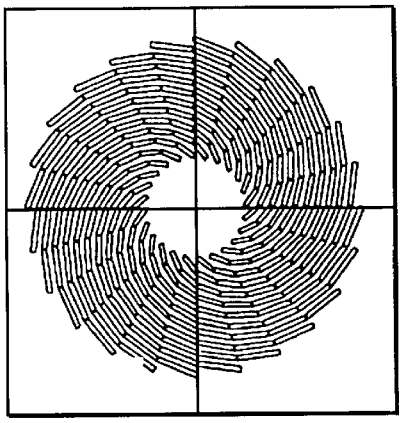
Figure 17E:
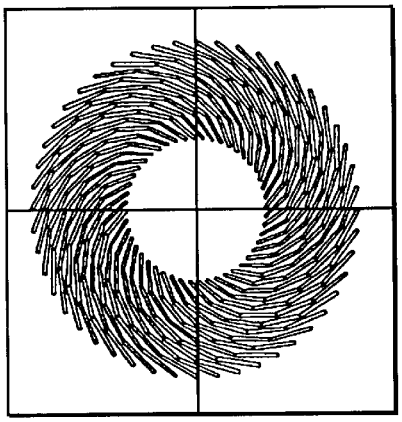

FIG. 17A has 3 lines with 24 angles for each 360 degrees, FIG. 17B has 4 lines with 24 angles, FIG. 17C has 12 lines with 24 angles, FIG. 17D has 24 lines with 24 angles, and FIG. 17E has 48 lines with 24 angles.

In each resonator shown: in FIGS. 16 and 17A–17E, the widths of each line and the spaces between adjacent lines are set to be 2 $\mu$m. These figures show only the central portions of the respective resonators.

Figure 18:
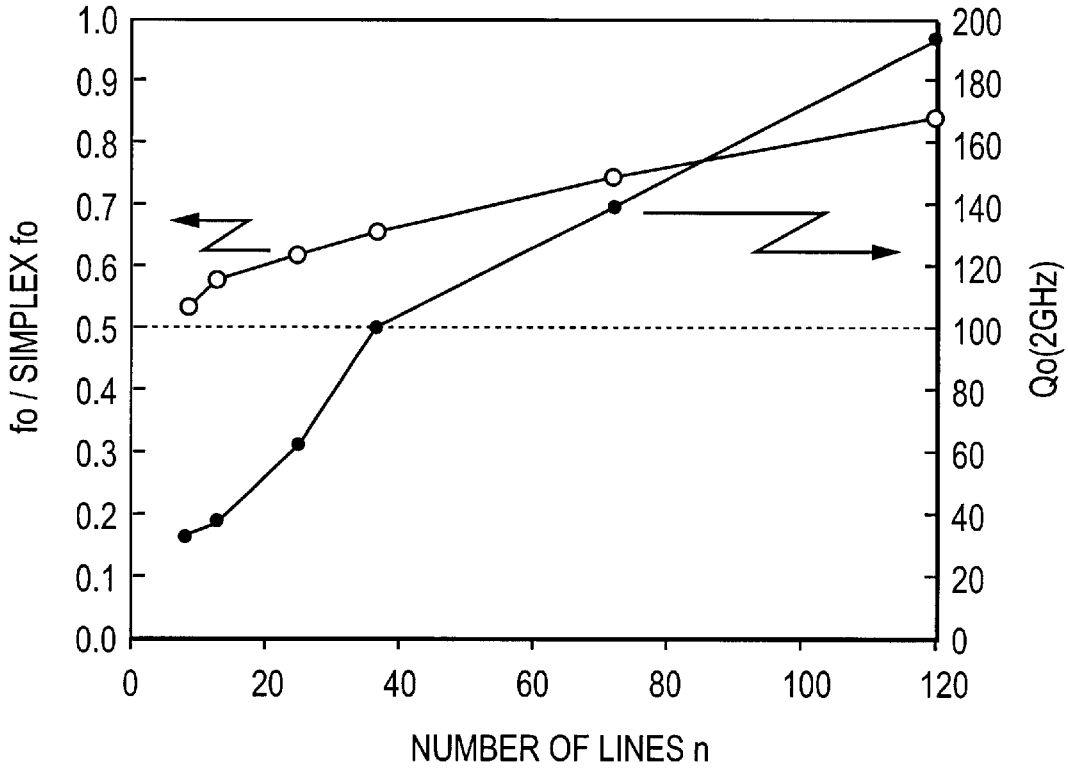
FIG. 18 is a graph showing the relationship between the number of lines, Q0, and f0.

FIG. 18 shows the relationship of $Q_o$ and ($f_o$/simplex $f_o$) with respect to the number of lines n, when folded lines are used as the lines.

In this example, the lines are wound from the outside to the inside by fixing the outer periphery of wound lines within a circle whose diameter is 2.8 mm, in such a manner that a resonant frequency of 2 GHz can be obtained. The simplex $f_o$ of the denominator is a resonant frequency obtained from the physical length, and $f_o$ of the numerator is a resonant frequency obtained by measurement. As is evident in the graph, since the number of lines used is inversely proportional to the amount of parasitic capacitance between the lines, reduction in $f_o$ due to parasitic capacitance is decreased, whereas the area occupied by the lines for obtaining the same resonant frequency is increased. However, the phase difference between adjacent lines is smaller, and loss is thereby reduced, which leads to improvement in $Q_o$.

The above phase difference between adjacent lines is equivalent to, at an arbitrary point on a line, the difference between current phases on the adjacent lines to the right and the left at the nearest distance from the line. This can be defined as a value (spatial phase difference) of an electric angle representing the deviation obtained when the voltage or current node and antinode in the longitudinal direction of a certain line are compared with those of the adjacent lines. Since the spatial phase difference is smaller at the inward side of the multi-spiral pattern, whereas it is larger at the outward side thereof, an average spatial phase difference is set as an index for designing. In this situation, when the number of lines is indicated by the symbol n, an average spatial phase difference $\Delta\theta$ is given by an equation $\Delta\theta=180°/n$ in the case of a half-wavelength resonator.

As described above, since the larger the number of lines, the smaller the average spatial phase difference, the structure is characteristically beneficial. However, the number of lines cannot be increased without limit because the obtainable pattern-forming precision is limited. As long as the characteristic obtained is the priority, it is preferable that the number of lines should be 24 or more. In other words, in the case of a half-wavelength resonator, when the number of lines is 24, the average spatial phase difference $\Delta\theta$ is obtained by an equation $\Delta\theta=180°/24=7.5°$, with the result that the average spatial phase difference is preferably 7.5° or lower. In addition, when easy manufacturing is the priority, it is preferable that the line width and the space between lines should be set to be two or three microns or larger and the number of lines automatically determined by the area occupied by the lines should be a maximum.

[Seventh Embodiment]

Figure 19A:
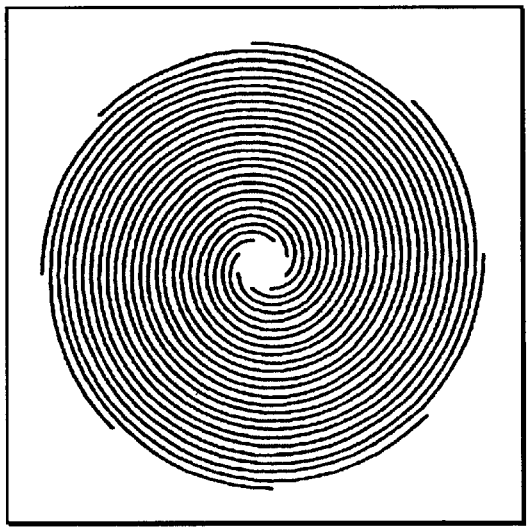
Figure 19B:
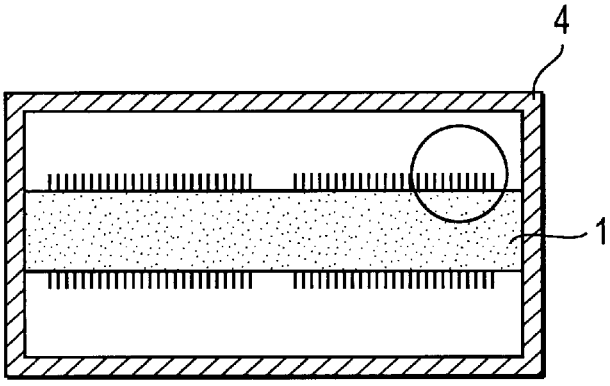
Figure 19C:
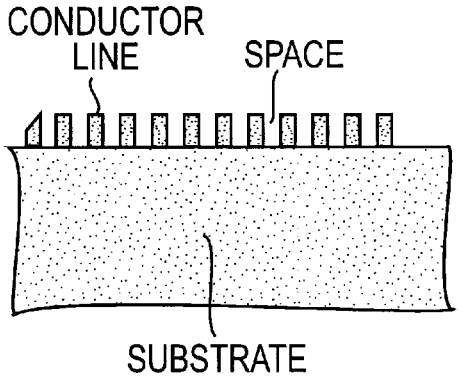

In examples of FIGS. 19A to 19C, lines which form mutually surface-symmetric multi-spiral patterns are formed on both surfaces of a dielectric substrate 1, which is disposed inside a metal cavity 4. With such a structure, since symmetric characteristics of the resonant electromagnetic field are enhanced, the concentration of current-density. distribution is avoided, and lower loss. characteristics can be obtained.

[Eighth Embodiment]

Figure 20:
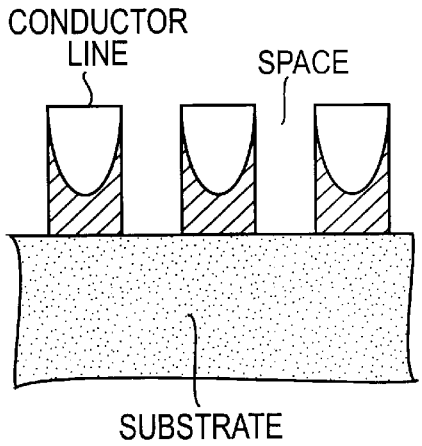
FIG. 20 is an enlarged sectional view of the lines of a resonator according to an eighth embodiment of the present invention.

FIG. 20 is an enlarged sectional view of lines formed on a substrate. In this case, the width of each line is substantially equal to or narrower than the skin depth of a conductor part of the line. With this arrangement, the width becomes a distance where current flowing for maintaining magnetic flux passing through the spaces at the right and left of the conductor part interferes at the right and left, by which a reactive current having a phase deviating from the resonant phase can be reduced. As a result, power losses can be greatly reduced.

[Ninth Embodiment]

Figure 21:
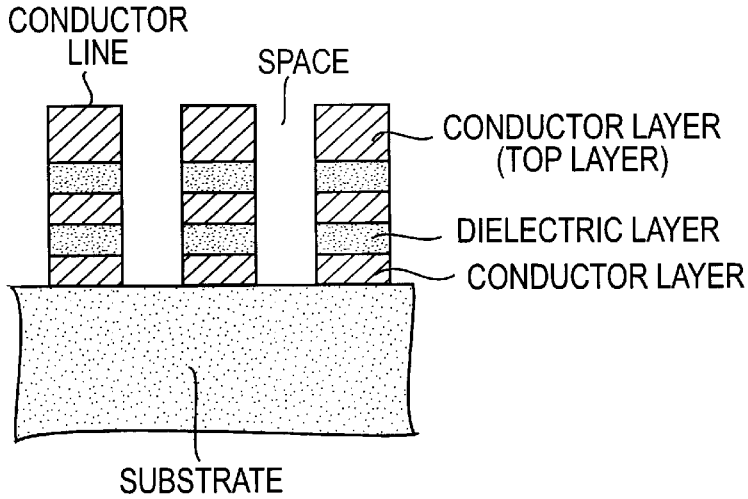
FIG. 21 is an enlarged sectional view of the lines of a resonator according to a ninth embodiment of the present invention.

FIG. 21 is an enlarged sectional view of the lines. In this figure, on a surface of the dielectric substrate, a thin-film conductor layer, a thin-film dielectric layer, another thin-film conductor layer, and another thin-film dielectric layer are laminated in sequence. Furthermore, a conductor layer is disposed on the top of the structure to form a thin-film multi-layer electrode having a three-layered structure as each line. In this way, multiple thin films are laminated in the film-thickness direction, by which the skin effect due to the interface of the substrate can be alleviated, which leads to a further reduction in conductor losses.

Figure 22:
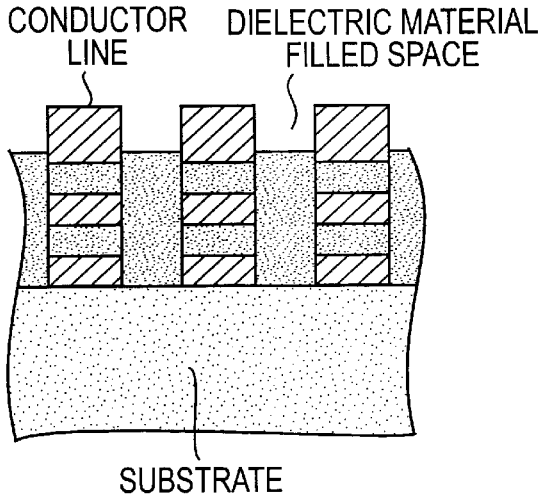
FIG. 22 is an enlarge d sectional view of the lines of another resonator according to the ninth embodiment of the present invention.

In FIG. 22, a dielectric material is filled in the space of the thin film multi-layer electrode.. With this structure, short-circuiting between adjacent lines and that between the layers can be easily prevented, with the result that reliability and characteristic stabilization can be improved.

[Tenth Embodiment]

Figure 23:
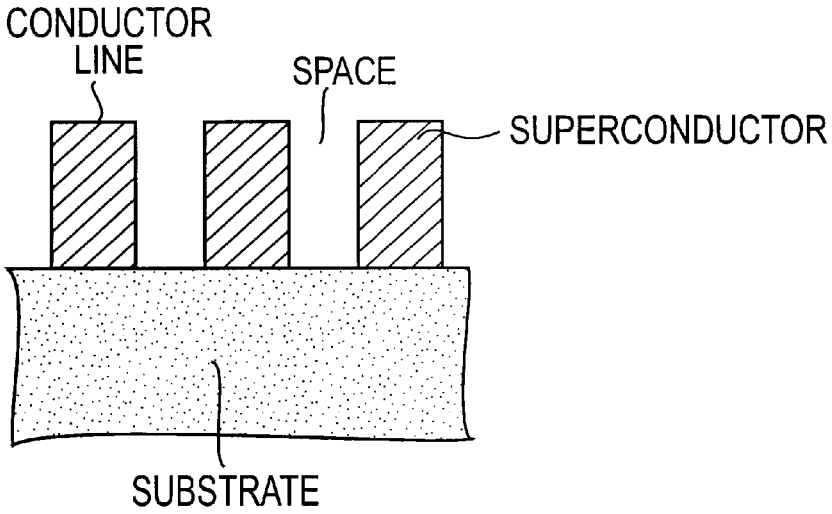
FIG. 23 is an enlarged sectional view of the lines of a resonator according to a tenth embodiment of the present invention.

FIG. 23 is an enlarged sectional view of the conductor part. In this example, a superconductor is used as the material of the line electrode. For example, a high-temperature superconductor material such as yttrium or bismuth can be used. In general, when a superconducting material is used for an electrode, it is necessary to determine the maximum level of current density so as not to reduce withstand power characteristics. However, in this invention, since the lines are formed into a multi-spiral pattern, they substantially have no edges, so that large current concentration does not occur. As a result, the lines can be used easily at a level of critical current density of the superconductor or at a lower level than that. Accordingly, the low loss characteristics of the superconductor can be effectively used.

[Eleventh Embodiment]

Figure 24:
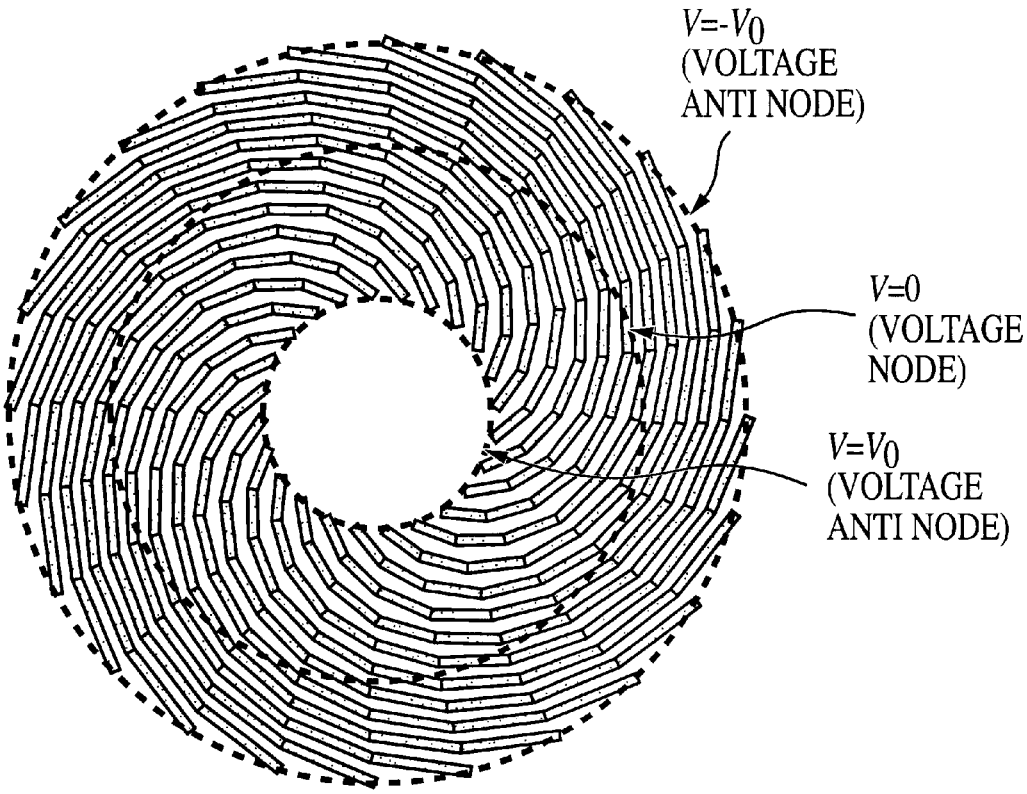
FIG. 24 is a view showing the structure of a resonator according to an eleventh embodiment of the present invention;.

FIG. 24 shows the structure of another resonator using lines whose two ends are open formed in a multi-spiral pattern. In this example, the lines form a resonator by mutual inductance and capacitive coupling among them. In this figure, circular dotted lines are typical equipotential lines, in which the inner periphery and outer periphery of the lines are equivalent to a voltage antinode, and the intermediate position is equivalent to a voltage node. However, the closer to the outer periphery, the larger the phase difference between adjacent lines and the capacitance between the lines. Thus, the voltage node is closer to the outer periphery than to the inner periphery, being set apart from the intermediate position between the inner periphery and the outer periphery.

In the eleventh embodiment, one or more parts of the lines having an equipotential are connected to each other by a conductor member, which is hereinafter referred to as an equipotential connecting line. FIGS. 25A–25E show examples of such embodiments.

As described above, since the parts of the lines having equal potentials are mutually connected by a conductor member, the potentials at specified positions of the lines are forcibly equalized and the operation of the resonator is thereby stabilized. In addition, since the parts on the lines initially having equal potentials are mutually connected, influence on the resonant mode is small.

In the examples shown in FIGS. 25A to 25E, although equipotential connecting lines are disposed at positions such as the voltage antinode and node, it is also possible to connect the equipotential parts of the lines at other positions.

[Twelfth Embodiment]

Figure 26A:
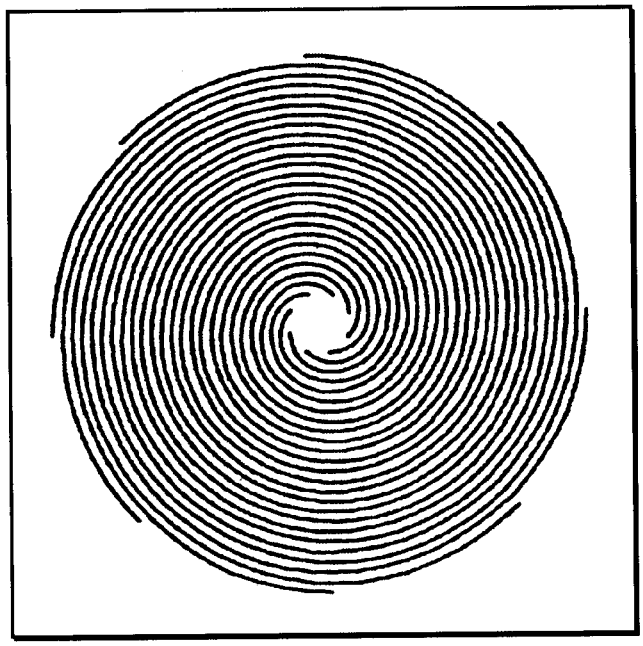
FIGS. 26A and 26B show views illustrating the example of a higher mode of a resonator according to a twelfth embodiment of the present invention.
Figure 26B:
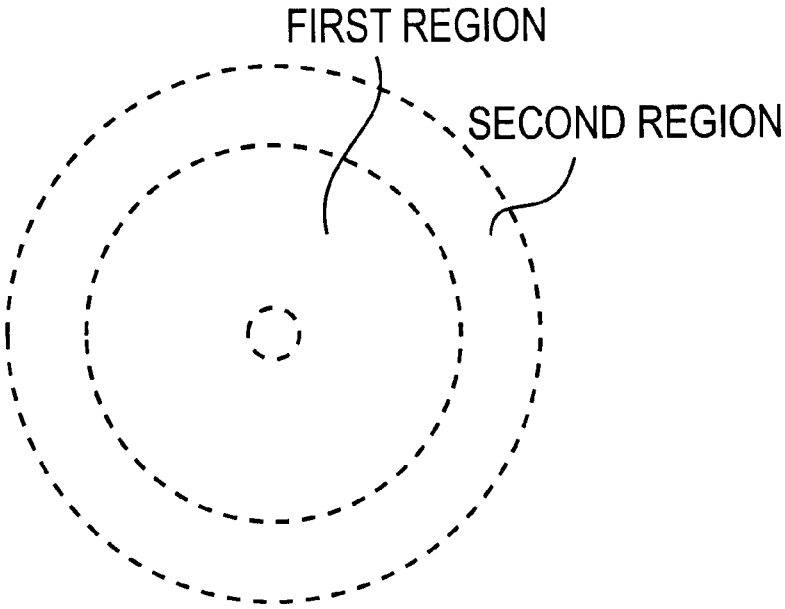

Although the above-described embodiments utilize a fundamental mode of the resonator, the second-order harmonic or higher resonant modes can also be used. In FIGS. 26A and 26B, the second-order mode occurs, in which full-wavelength resonance is generated on the line lengths. When current amplitude is considered, two antinodes exist in FIG. 26B. In the first region, current flows in an outward direction, whereas, in the second region, current flows in an inward direction. After half a period has passed, the opposite combination occurs. In this case, since the phase difference between adjacent lines in the second region is larger than that in the first region, by which capacitance between the lines is generated, the area of the second region becomes slightly smaller than that of the first region. Although the resonant frequency is larger in the second-order mode than the fundamental mode, it becomes equal to or less than twice the fundamental mode due to the occurrence of the capacitance between the lines. Although an unloaded Q is lower than in the fundamental mode, when it is used in designing a filter, it has a positive effect from the standpoint of widening the bandwidth of the filter.

[Thirteenth Embodiment]

Figure 27A:
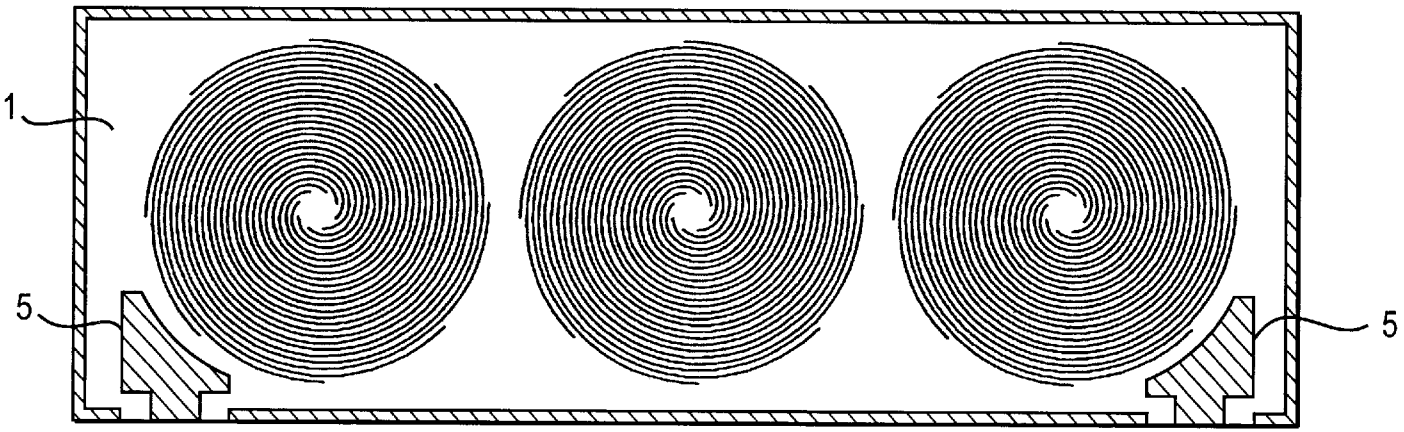
Figure 27B:
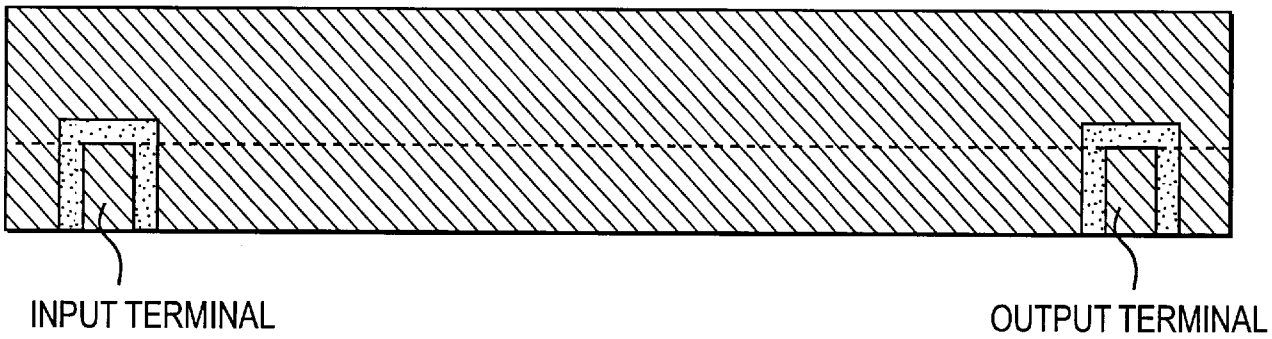

In the embodiment shown in FIGS. 27A and 27B, on the upper surface of a dielectric substrate 1, three resonators having the same multi-spiral patterns as that shown in FIG. 1 are disposed, and external coupling electrodes 5 are capacitively coupled respectively to the resonators at both ends of the series of three resonators. The external coupling electrodes 5 are led out on the front surface of the filter, which is an external surface thereof, as an input terminal and an output terminal. Ground electrodes are formed on the lower surface and on the four side surfaces of the dielectric substrate. In addition, on the top of the dielectric substrate, another dielectric substrate is stacked, on the top and four side surfaces of which ground electrodes are formed. This arrangement permits a filter incorporating resonators in a triplet structure to be formed. With this structure, since adjacent resonators form an inductive coupling, a three-stage filter having a band pass characteristic incorporating three resonators can be obtained.

[Fourteenth Embodiment]

Figure 28:
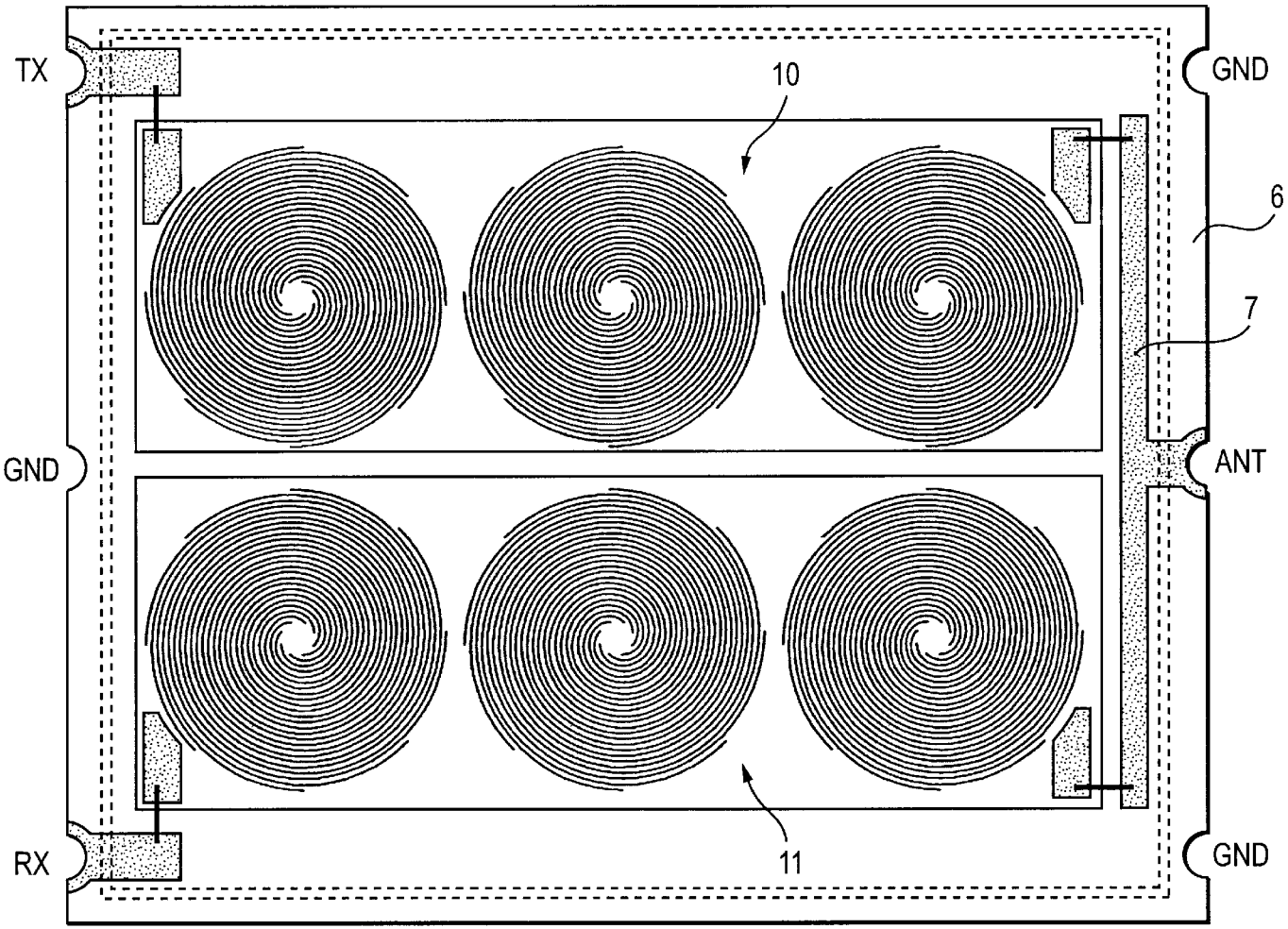
FIG. 28 is a view showing the structure of a duplexer according to a fourteenth embodiment of the present invention.

FIG. 28 is a top view showing the structure of a duplexer, in which an upper shielding cover is removed. In this figure, reference numerals 10 and 11 denote filters each having a structure of the dielectric substrate shown in FIG. 27. The filter 10 is used as a transmitting filter, and the filter 11 is used as a receiving filter. Reference numeral 6 denotes an insulated substrate, on the top of which the filters 10 and 11 are mounted. On the substrate 6, a branching line 7, an antenna (ANT) terminal, a transmitting (TX) terminal, and a receiving (RX) terminal are formed, and external coupling electrodes of the filters 10 and 11 and the electrode portions formed on the substrate 6 are connected by wire bonding. On almost the entire upper surface of the substrate 6, except the terminal parts, a ground electrode is formed. A shielding cover is disposed along the dotted-line parts of the top of the substrate 6, as shown in the figure.

Figure 29:
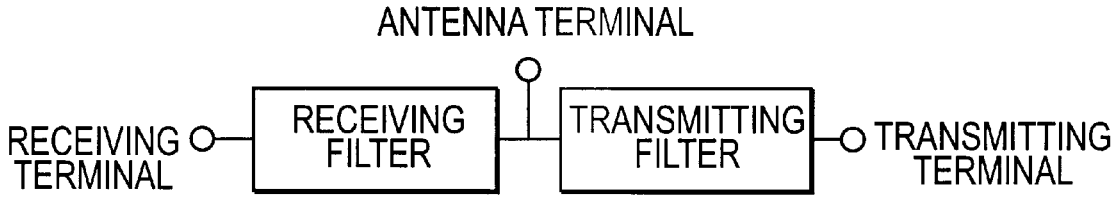
FIG. 29 is a block diagram of the duplexer.

FIG. 29 is an equivalent circuit diagram of the duplexer. With this structure, a transmitted signal is not allowed to enter a receiving circuit and a received signal is not allowed to enter a transmitting circuit. In addition, regarding signals from the transmitting circuit, only the signals in a transmitting frequency band are allowed to pass through to an antenna, and regarding signals received from the antenna, only the signals in a receiving frequency band are allowed to pass through to a receiving device.

[Fifteenth Embodiment]

Figure 30:
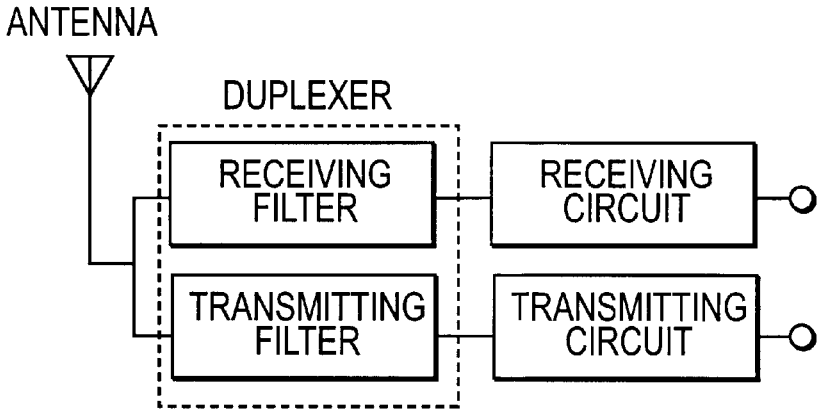
FIG. 30 is a block diagram showing the structure of a communication device according to a fifteenth embodiment of the present invention.

FIG. 30 is a block diagram showing the structure of a communication device. This communication device uses a duplexer having the same structure as that shown in FIGS. 28 and 29. The duplexer is mounted on a printed circuit board in such a manner that a transmitting circuit and a receiving circuit are formed on the printed circuit board, or may be disposed separately. The transmitting circuit is connected to a TX terminal of the duplexer, the receiving circuit is connected to an RX terminal of the duplexer, and an antenna is connected to an ANT terminal of the duplexer. The antenna may be removable from the ANT terminal as is conventional.

[Sixteenth Embodiment]

Figure 25A:
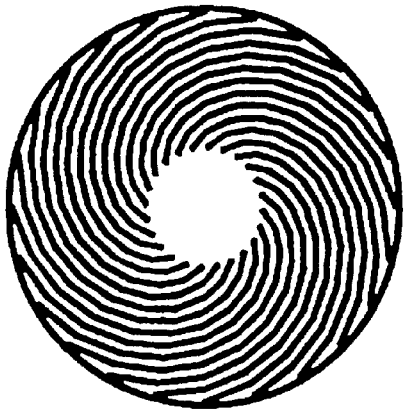
Figure 25B:
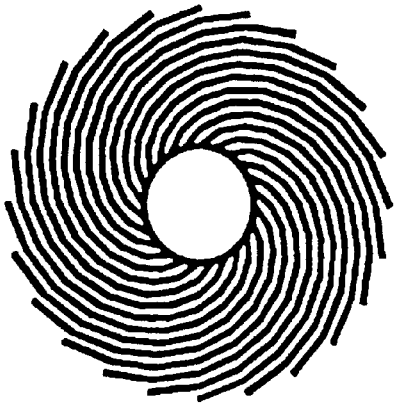
Figure 25C:
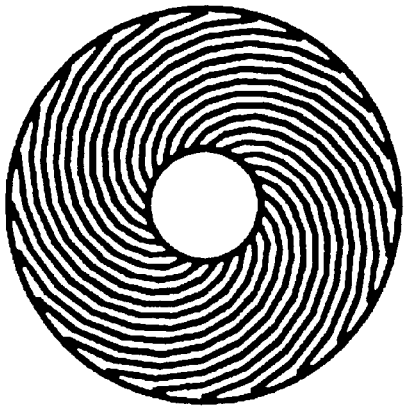
Figure 25D:
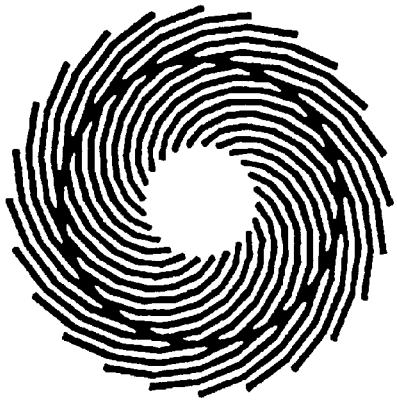
Figure 25E:
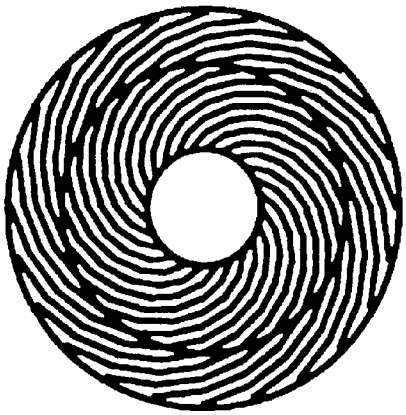

In the embodiments of the resonators described above, the inward end portions of the plural lines forming a multi-spiral pattern remain separated, or as shown in FIGS. 25B, 25C and 25E, they are connected by an equipotential connecting line. However, in other embodiments described below including the sixteenth one, the inward end portions of the lines are connected to electrodes which are disposed at the center of a multi-spiral pattern.

Figure 31A:
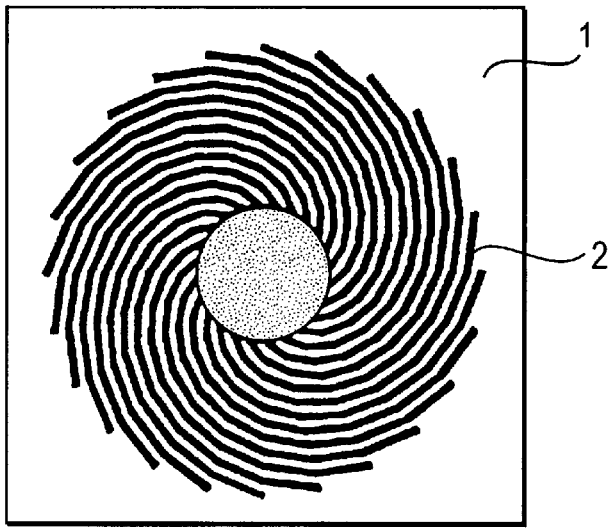
Figure 31B:
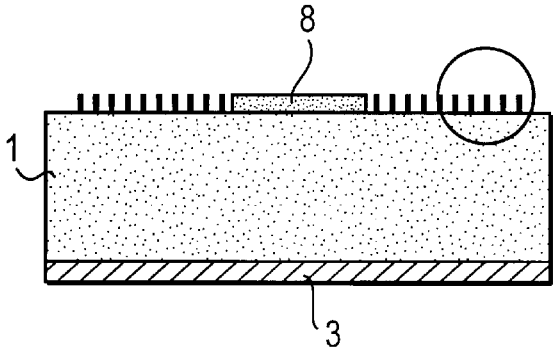
Figure 31C:
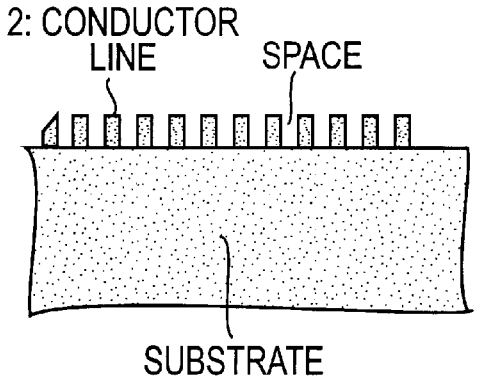

In the resonator of the structure shown in FIGS. 31A to 31C, a ground electrode 3 is formed on the entire lower surface of a dielectric substrate 1, and a multi-spiral pattern is formed on the top surface thereof. In addition, a central electrode 8 is connected to the inner peripheral end of each line 2 of the multi-spiral pattern.

In this way, since the central electrode 8 is disposed at the center of the set of lines, the inward end portions of the lines are commonly connected by the central electrode 8 to have equal potentials. As a result, the boundary conditions of the inward end portions of the lines are forcibly equalized, by which stabilized resonance of the lines is obtained in a ½-wavelength resonant mode, with the inner peripheral ends and outer peripheral ends of the lines being open ends. In this situation, spurious modes are suppressed.

Furthermore, since capacitance is generated between the central electrode 8 and the ground electrode 3, the capacitance component of the resonator is increased. Accordingly, in order to obtain the same resonant frequency among the lines, the length of the lines can be shortened, with the result that the area occupied by the overall resonator can be reduced, while maintaining the low loss characteristic obtained by the multi-spiral pattern.

Furthermore, the central electrode 8 can also be used as an electrode for external input or output. For example, the central electrode 8 can be wire-bonded to an external input-output terminal.

[Seventeenth Embodiment]

Figure 32A:
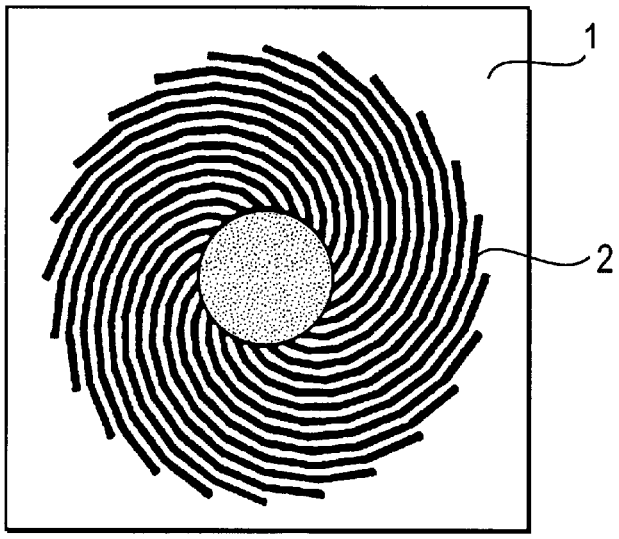
Figure 32B:
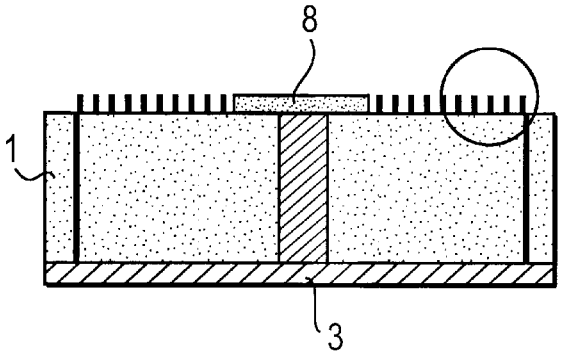
Figure 32C:
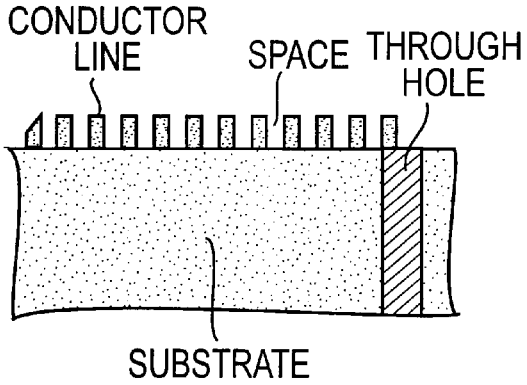

In a resonator shown in FIGS. 32A to 32C, a central electrode 8 is disposed in the center of a multi-spiral pattern, and the inner peripheral end and outer peripheral end of each line are grounded to a ground electrode 3 via a through-hole. In this way, as in the case described above, stabilization of the resonant mode can be achieved by providing the central electrode 8. Further, the central electrode can easily be accessed from the exterior, so that the user has an additional possibility of connecting the resonator with an external electrical element. As the through-hole connecting the central electrode 8 and the ground electrode 3, a cavity as shown in FIGS. 11A–11C, or a hole filled with a conductor material can be used.

[Eighteenth Embodiment]

Figure 33A:
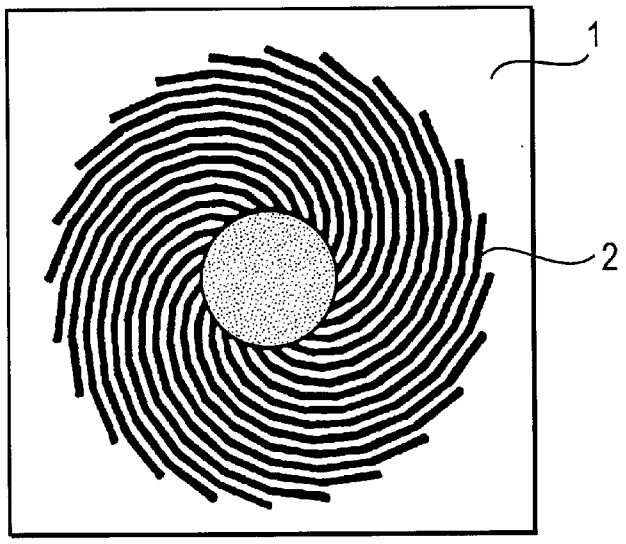
Figure 33B:
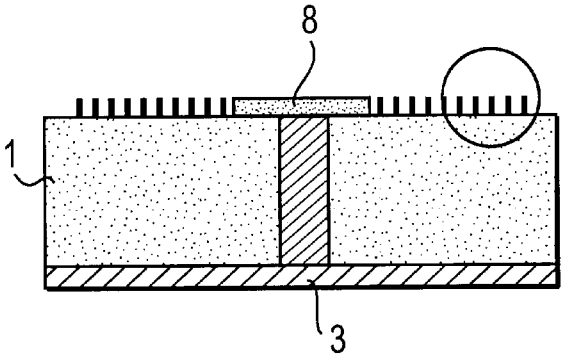
Figure 33C:
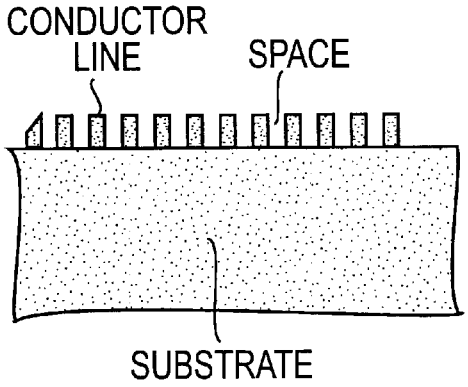

In a resonator shown in FIGS. 33A to 33C, a central electrode 8 is disposed in the center of a multi-spiral pattern, and the inner peripheral end of each line is grounded to a ground electrode 3 via a through-hole. The outer peripheral end of each line remains open. This arrangement permits the resonant lines to operate as a ¼-wavelength resonator. In this way, as in the case described above, stabilization of the resonant mode can be achieved by providing the central electrode 8. Further, the central electrode can easily be accessed from the exterior, so that the user has an additional possibility of connecting the resonator with an external electrical element.

[Nineteenth Embodiment]

Figure 34A:
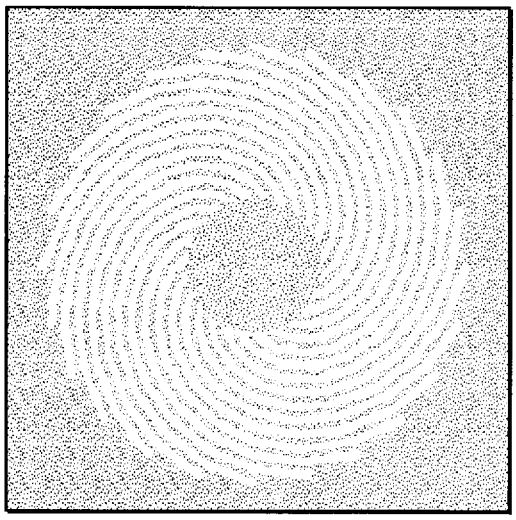
Figure 34B:
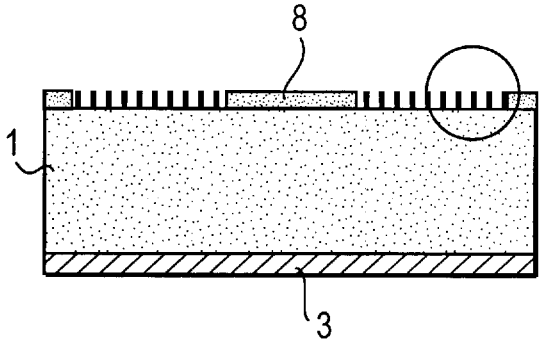
Figure 34C:
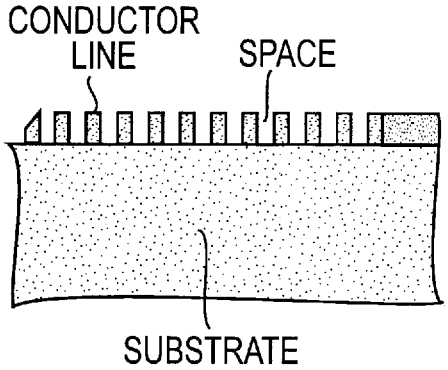

In the example shown in FIGS. 34A to 34C, a central electrode 8 is disposed in the center of a resonator having a multi-spiral pattern formed of slot lines, as shown in FIGS. 13A–13C. As the above cases, in the arrangement of slot lines, stabilization of the resonant mode, and reduction in the size of a resonator, can be achieved by providing the central electrode 8. Further, the central electrode can easily be accessed from the exterior, so that the user has an additional possibility of connecting the resonator with an external electrical element.

[Twentieth Embodiment]

Figure 35A:
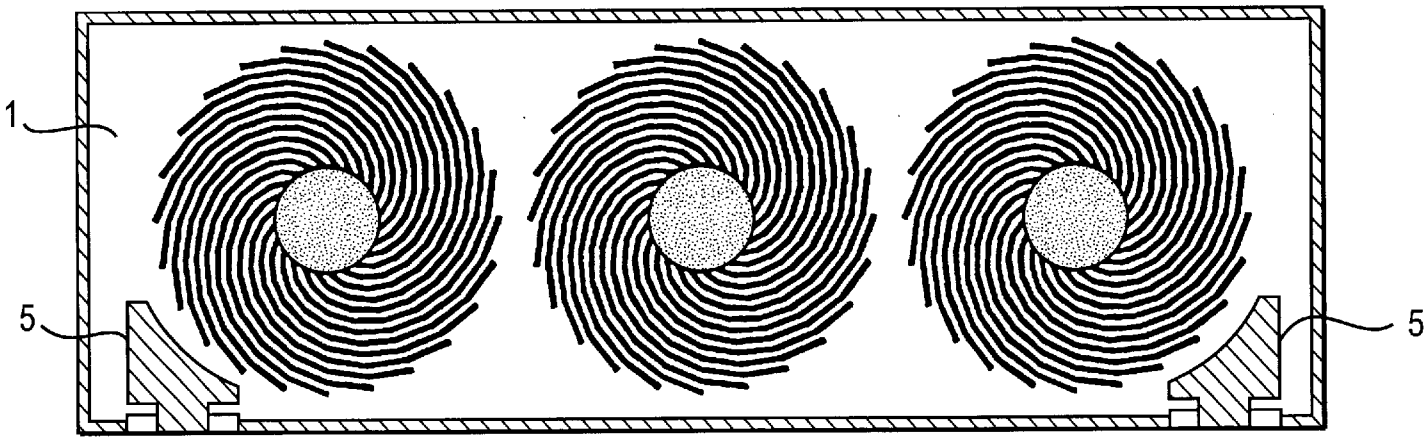
FIGS. 35A and 35B show views illustrating the structures of a filter according to a twentieth embodiment of the present invention.
Figure 35B:
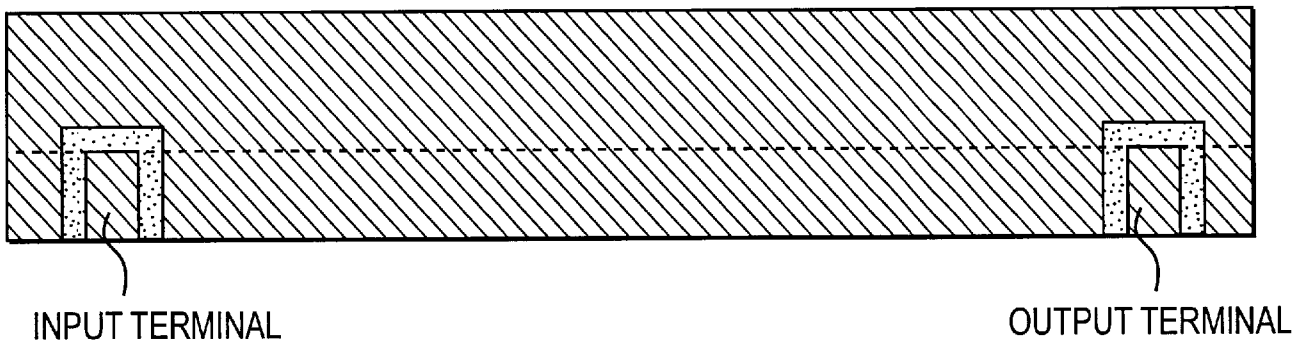

FIGS. 35A and 35B show the structure of a filter using the resonators shown in FIGS. 31A to 31C. Except for a central electrode incorporated in each resonator, the other arrangements are the same as those in the filter shown in FIGS. 27A–27B. Three multi-spiral patterns having the central electrodes are arranged on the top surface of a dielectric substrate 1, and external coupling electrodes 5 are formed for making capacitive-coupling respectively to the resonators positioned at both ends of the arrangement. The external coupling electrodes 5 are led out respectively to an input terminal and an output terminal on the front surface (an external surface) of the filter shown in the figure. Ground electrodes are formed on the lower surface and on the four side surfaces of the dielectric substrate. In addition, on the top of the dielectric substrate, another dielectric substrate is stacked. Ground electrodes are also formed on the top surface and four side surfaces of the other dielectric substrate. This arrangement forms a filter having the resonators in a triplet structure.

With this structure, inductive coupling between adjacent resonators is formed and a band pass characteristic can be provided by the three resonator stages. Furthermore, since each resonator can be made small, the overall filter can also be made small. In addition, since the resonator has good spurious-mode suppression, a filter characteristic having good spurious mode characteristics can be obtained.

Although the present invention has been described in relation to particular embodiments thereof, many other variations and modifications and other uses will become apparent to those skilled in the art. Therefore, the present invention is not limited by the specific disclosure herein.

What is claimed is:

1. A resonator comprising:

a substrate; and a set of lines comprising a plurality of spiral lines;

wherein inner and outer ends of the spiral lines are distributed substantially along an inner periphery and an outer periphery of the set of lines respectively, the inner and outer peripheries being centered around a specified point on the substrate, wherein the lines do not cross each other and wherein the width of at least one of the lines is substantially equal to or narrower than the skin depth of a conductor material of the line at a resonant frequency of the resonator.

2. A resonator comprising:

a substrate; and a set of lines comprising a plurality of spiral lines;

wherein the spiral lines are disposed in rotation-symmetrical positions around a specified point on the substrate, wherein the spiral lines do not cross each other, and wherein the width of at least one of the lines is substantially equal to or narrower than the skin depth of a conductor material of the line at a resonant frequency of the resonator.

3. A resonator comprising:

a substrate; and a set of lines comprising a plurality of lines formed thereon, each line being indicated by a monotonically increasing or decreasing line in a polar-coordinate expression with one axis representing angles and the other axis representing radius vectors;

wherein each line is arranged on the substrate in such a manner that a width of the line is within an angular width equal to or less than a value obtained by dividing $2\pi$ radians by the number of the lines, and the width of the overall set of the lines is constantly within an angular width of $2\pi$ radians or less at any arbitrary radius vector.

4. A resonator according to one of claims 1, 2, or 3, wherein an electrode is disposed on the substrate at the center of the set of lines, and the lines are connected to the electrodes.

5. A resonator according to one of claims 1, 2 or 3, wherein equipotential portions of the plurality of lines are mutually connected by a conductor member.

6. A resonator according to one of claims 1, 2 or 3, wherein at least one end portion of each of the plurality of lines is grounded to a ground electrode.

7. A resonator according to one of claims 1, 2 or 3, wherein each of the plurality of lines comprises a respective folded line.

8. A resonator according to one of claims 1, 2 or 3, wherein the widths of the plurality of lines and a distance between adjacent lines are substantially equal from one end portion of the lines to the other end portion thereof.

9. A resonator according to one of claims 1, 2 or 3, wherein the width of each of the plurality of lines is substantially equal to or narrower than the skin depth of a conductor material of the line at a resonant frequency of the resonator.

10. A resonator according to one of claims 1, 2 or 3, wherein each of the plurality of lines is a thin film multilayer electrode comprising a lamination of a thin-film dielectric layer and a thin-film conductor layer.

11. A resonator according to one of claims 1, 2 or 3, wherein a dielectric material is filled in a space between adjacent lines of the plurality of lines.

12. A resonator according to one of claims 1, 2 or 3, wherein at least one of the plurality of lines is formed of a superconducting material.

13. A resonator according to one of claims 1, 2 or 3, further comprising a conductive cavity which shields said substrate and said set of lines.

14. A resonator according to one of claims 1, 2 or 3, wherein said plurality of lines comprises at least 24 lines.

15. A filter comprising the resonator in accordance with one of claims 1, 2 or 3, further comprising signal input and output conductors disposed adjacent to the resonator.

16. A duplexer comprising the filter in accordance with claim 13, the duplexer having a transmitting terminal, a receiving terminal, and an antenna terminal, said signal input and output conductors being connected respectively to a pair of said terminals, and further comprising a second filter having input and output conductors connected respectively to a second pair of said terminals.

17. A communication device comprising:

a transmitting circuit;

a receiving circuit; and the duplexer in accordance with claim 16;

said transmitting circuit being connected to said transmitting terminal; and said receiving circuit being connected to said receiving terminal.

18. A communication device comprising:

a transmitting circuit;

a receiving circuit; and the filter in accordance with claim 15;

wherein at least one of said signal input and output said conductors is connected to at least one of said transmitting circuit and said receiving circuit.

* * * * *